US007728503B2

(12) United States Patent
Ohta et al.

(10) Patent No.: US 7,728,503 B2
(45) Date of Patent: Jun. 1, 2010

(54) ELECTRON EMISSION ELEMENT, CHARGING DEVICE, PROCESS CARTRIDGE, AND IMAGE FORMING APPARATUS

(75) Inventors: Eiichi Ohta, Kanagawa (JP); Takuro Sekiya, Kanagawa (JP); Naomi Sugimoto, Kanagawa (JP); Yukimichi Someya, Tokyo (JP); Shohji Tanaka, Kanagawa (JP); Yasuo Katano, Kanagawa (JP); Yoshihiko Iijima, Miyagi (JP); Toshihiro Ishii, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 514 days.

(21) Appl. No.: 11/692,654

(22) Filed: Mar. 28, 2007

(65) Prior Publication Data

US 2007/0231010 A1 Oct. 4, 2007

(30) Foreign Application Priority Data

Mar. 29, 2006 (JP) ..... 2006-091303
Mar. 29, 2006 (JP) ..... 2006-091315

(51) Int. Cl.
*H01J 1/62* (2006.01)

(52) U.S. Cl. ..... 313/495; 313/582; 313/496; 313/497; 445/24; 445/25

(58) Field of Classification Search ..... 313/582–587, 313/558, 495–497; 315/169.3; 445/24–25
See application file for complete search history.

(56) References Cited

U.S. PATENT DOCUMENTS 5,384,517 A * 1/1995 Uno ..... 315/169.3
6,489,720 B1 * 12/2002 Gofuku et al. ..... 313/558
2006/0055323 A1 * 3/2006 Hatanaka et al. ..... 313/583

FOREIGN PATENT DOCUMENTS

JP 57-178257 11/1982

(Continued)

OTHER PUBLICATIONS

English Translation of JP2003-145826.*

(Continued)

*Primary Examiner*—Nimeshkumar D. Patel
*Assistant Examiner*—Mary Ellen Bowman
(74) *Attorney, Agent, or Firm*—Oblon, Spivak, McClelland, Maier & Neustadt, L.L.P.

(57) ABSTRACT

An electron emission element according to the present invention is compact, thin and low cost, and has a structure and constitution in which deterioration of the electron emission material itself is low. In the electron emission element, boron nitride material is used as the electron emission material, and a metal material or a semiconductor material is used as a substrate for forming the boron nitride material. In this way it is possible to obtain good quality boron nitride material on the substrate. Also, a voltage can be applied to the material to emit electrons, also electrons can be supplied. Moreover, by using $Sp^3$-bonded boron nitride as the boron nitride material, and using $Sp^3$-bonded 5H—BN material or $Sp^3$-bonded 6H—BN material as the $Sp^3$-bonded boron nitride, a field electron emission element can be achieved for which high efficiency electron emission characteristics unprecedented in conventional art can be obtained.

23 Claims, 12 Drawing Sheets

FOREIGN PATENT DOCUMENTS

| | | |
|---|---|---|
| JP | 58-40566 | 3/1983 |
| JP | 58-139156 | 8/1983 |
| JP | 58-150975 | 9/1983 |
| JP | 62-52866 | 11/1987 |
| JP | 63-7380 | 1/1988 |
| JP | 63-149669 | 6/1988 |
| JP | 3119431 | 10/2000 |
| JP | 2001-250467 | 9/2001 |
| JP | 2002-279885 | 9/2002 |
| JP | 2002-311684 | 10/2002 |
| JP | 2003-140444 | 5/2003 |
| JP | 2003-145826 | 5/2003 |
| JP | 3598381 | 9/2004 |
| JP | 2004-327084 | 11/2004 |

OTHER PUBLICATIONS

U.S. Appl. No. 12/186,906, filed Aug. 6, 2008, Someya, et al.

* cited by examiner

ELECTRON EMISSION ELEMENT, CHARGING DEVICE, PROCESS CARTRIDGE, AND IMAGE FORMING APPARATUS

BACKGROUND OF THE INVENTION

1. Field of the Invention

The present invention relates to an image forming apparatus such as a photocopier, printer, facsimile apparatus, composite machine that includes two or more of these, and plotter, and more particularly relates to an electron emission element (including a concept of a field electron emission element) used in a charging device provided in an image forming apparatus or an image display device such as a display or similar.

2. Description of the Background Art

Conventionally, image forming apparatus using the electrophotographic process are known, such as photocopiers, printers, facsimile apparatuses, composite machines that include two or more of these, and plotters. In the electrophotographic process, corona discharge is frequently used in the charge device that uniformly charges a photosensitive member, which is an image carrier, to form a latent image on the image carrier. In the corona discharge method, an electrically conducting case electrode is provided around a platinum or tungsten wire of diameter 50 to 200 μm, or a needle shaped electrode made from stainless steel material or similar. A direct current or alternating current bias voltage is applied between the electrode and the case. Then using the ions formed by ionizing the air molecules around the electrode, the photosensitive member is charged, and uniform charging is possible at a distance.

However, in the corona discharge method, air is ionized, and discharge products such as ozone and oxides of nitrogen (NOx) are generated. It is known that the quantity of ozone and oxides of nitrogen formed after 60 minutes of discharge can each amount to 4 to 10 ppm.

If ozone accumulates at high concentration within an image forming apparatus, the surface of the photosensitive member can become oxidized, the photosensitivity of the photosensitive member can be reduced, the charging capacity can deteriorate, image forming deteriorates, and so on. However, "Development of a corona charger to reduce the deterioration of the photosensitive member due to ozone", Hisashi Myochin et al., was published in the Journal of the Imaging Society of Japan, No. 31, January 1992. Also, deterioration of parts other than the photosensitive member is accelerated, the life of components is reduced, and other problems are caused.

Also, oxides of nitrogen cause problems as follows. In other words, it is known that oxides of nitrogen are formed by electrical discharge. However, oxides of nitrogen react with moisture in the air to generate sulfuric acid, which then reacts with metals and so on to form metal sulfates. These products have high resistance under a low humidity environment, but under a high humidity environment they react with the moisture in the air, and their resistance becomes low. Therefore, if a thin film of sulfuric acid or sulfates forms on the surface of the photosensitive member, abnormal images are generated, as if the image were flowing. This is caused by absorption of water by sulfuric acid or sulfates and reduction of their resistance, which causes damage to the electrostatic latent image on the surface of the photosensitive member.

Furthermore, oxides of nitrogen remain in the same place without dissociating in the air after discharge. Therefore, compounds formed from oxides of nitrogen adhere to the surface of the photosensitive member, and are generated even when charging is not carried out, in other words, when the process is stopped. Also, as time passes these compounds penetrate into the photosensitive member from the surface, which is one of the causes of degeneration of the photosensitive member. In this case, matter adhering to the surface of the photosensitive member is eliminated by removing the surface of the photosensitive member little by little when cleaning. However, this increases the cost and brings the new problem that it causes deterioration with time.

Also, in the corona discharge method, discharge is carried out at a distance, so the applied voltage is fairly high (4 kV to 10 kV). In addition, the charging voltage varies with charging time. Therefore, to obtain the necessary voltage (400V to 1000V) it is necessary to make the width of the case electrode in the direction of rotation of the photosensitive member large when the speed of the photosensitive member is large. Therefore it is difficult to reduce the size of image forming apparatus having high printing speed.

On the other hand, the close roller charging method is also widely used. In the close roller charging method, a direct or alternating current bias is applied between the photosensitive member and a charging member (charging roller) held close to the photosensitive member. Discharge occurs in the gap between the two, and the photosensitive member is charged. In this charging method, the charging phenomenon in accordance with Paschen's law is used. The required charging voltage is obtained by forming a voltage difference that is larger than the discharge start voltage by the amount of the required charging voltage.

In this case, with the alternating current bias method, the direction of the electric field between the charging member and the photosensitive member alternates with time; discharge and reverse discharge are repeated. With the alternating current bias method, charging is carried out by charging and reverse charging. Although this has the advantage that more uniform charging can be obtained, the hazard (the phenomenon in which the photosensitive member is oxidized by highly oxidizing activated species generated by atmospheric discharge) to the photosensitive member due to discharge is very high.

In this way, charge has been applied to the photosensitive member by some type of charging means that uses Paschen discharge to date. As a result, discharge products formed by the discharge have adhered to the surface of the photosensitive member, and it is not possible to avoid the hazard of the surface of the photosensitive member being oxidized by active species formed by the discharge. Therefore, currently, to reduce the deterioration with time of the image quality and to maintain the image quality, the surface of the photosensitive member is very slightly removed, as described above. On the other hand, this removal consumes the photosensitive member, and from the long term point of view it is preferable to avoid it. However, there is a trade off with preventing the deterioration in image quality due to the photosensitive hazard as described above, so a fundamental solution to the problem is difficult.

Furthermore, there is a contact charging device in which the charging member contacts the photosensitive member when charging the photosensitive member. This is, for example, a roller shaped charging member that charges the photosensitive member while contacting and being rotated by the photosensitive member. With the contact charging method, there is the advantage that the quantity of ozone generated is low compared with the corona discharge method described above, about 0.01 ppm ozone generated after charging for 60 minutes with a direct current applied voltage.

Also, the applied voltage is low, so the power supply cost is low, and the electrical insulation design is easy to carry out.

As described in Prior Art 1 (Japanese Patent Application Laid-open No. S57-178257), Prior Art 2 (Japanese Patent Application Laid-open No. S56-104351), Prior Art 3 (Japanese Patent Application Laid-open No. S58-40566), Prior Art 4 (Japanese Patent Application Laid-open No. S58-139156), Prior Art 5 (Japanese Patent Application Laid-open No. S58-150975), and Prior Art 6 (Japanese Patent Application Laid-open No. S63-7380), and so on, in the contact charging method, a narrow gap is formed at the contacting portion or near the contacting portion. Then discharge is formed that can be described by Paschen's law, and the photosensitive member is charged. In these cases, by applying a direct current voltage that is equal to or greater than the voltage to start charging to an electrically conducting member, or, as described in detail in Prior Art 7 (Japanese Patent Application Laid-open No. S63-149669), by applying an oscillating voltage formed by superimposing an alternating current voltage onto a direct current voltage equivalent to the target charging voltage, uniformity of charging can be further promoted.

However, by applying an alternating current voltage, the direction of the electric field between the charging member and the photosensitive member alternate switch time. Discharge and reverse discharge are repeated, and the charging is carried out by the discharge and reverse discharge. This has the advantage that more uniform charging is obtained. On the other hand, as the AC current increases, the generation of ozone and oxides of nitrogen also increase. Depending on the alternating current application conditions, generation of ozone can reach 3 ppm after 60 minutes of charging, a value near to that of the corona discharge method.

Also, on the other hand, as shown in Prior Art 8 (Japanese Patent Application Laid-open No. H8-106200), there is the method of contact injection charging, in which an electrically conducting member to which a voltage is applied contacts the photosensitive member, and charge is injected into trap levels in the surface of the photosensitive member. In this method, a roller shaped electrically conducting member (charging roller) is commonly used as the shape of the electrically conducting member, for ease of control of contact and separation.

However, the charging member that forms the charging roller is made from rubber, so the roller could become deformed if in contact with the photosensitive member for a long time when the image forming apparatus is stopped. Also, rubber can easily absorb moisture, so the fluctuations in electrical resistance as the environment changes are large. Furthermore, to bring out the elasticity of the rubber and to prevent deterioration, several types of plasticizer and activator are necessary. Also, dispersion promotion agent is frequently used to disperse electrically conducting pigment. In other words, the surface of the photosensitive member is made from non-crystalline resin such as polycarbonate or acrylic, so there is the problem that it is very weak with respect to plasticizers and dispersion promotion agent referred to above.

Also, in the contact charging method, if foreign matter comes between the charging member and the photosensitive member, there is the problem that the charging member becomes dirty and charging defects occur. The roller directly contacts the photosensitive member, so if the dirt is held for a long time the photosensitive member becomes dirty. Therefore, there is the problem that image defects such as horizontal shifts or similar are caused.

Therefore, a method that uses an electron emission material has been gaining attention as a charging technology that is different from these technologies. For example, Prior Art 9 (Japanese Patent Art Laid-open No. 2003-145826) describes what is referred to as MIS (Metal Insulator Semiconductor) type and MIM (Metal Insulator Metal) type electron emission elements and an image forming apparatus using them. The MIS type and MIM type electron emission elements have a structure in which an electron emission layer made from insulating material and semiconductor layers, or insulating and metal material layers, is sandwiched between a substrate electrode and a thin film electrode.

Prior Art 10 (Japanese Patent Application Laid-open No. 2001-250467) discloses an electron emission element, a charging device using the electron emission element, and an image forming apparatus. The electron emission element has a structure in which the ends of carbon nanotubes are coated with metal or alloy (a), or at least one of a nitride, carbide, silicide, or boride (b).

Prior Art 11 (Japanese Patent Application Laid-open No. 2002-279885) discloses an electron emission device, a charging device using the electron emission device, and an image forming apparatus. The electron emission device includes a support member made from a quartz, glass, ceramic, metal, silicon or similar substrate; an emitter electrode formed by providing a metal or alloy film on one side of the support member; a plurality of anodized films disposed a predetermined distance above the emitter electrode, formed by anodizing a plurality of aluminum films in an acid such as sulfuric acid, perchloric acid, or similar; a plurality of fine holes formed between each anodized electrode of the plurality of anodized electrodes, having an aperture on the side opposite the emitter electrode; a plurality of carbon nanotubes that emits field electrons, disposed within the fine holes formed between each anodized electrode of the plurality of anodized electrodes, and whose bottom surfaces are in contact with the emitter electrode; and an extractor electrode that covers the apertures of the fine holes, wherein the carbon nanotubes are enclosed by the emitter electrode, the anodized films, and the extractor electrode.

Prior Art 12 (Japanese Patent Application Laid-open No. 2003-140444) discloses an electron emission element, a charging device using the electron emission element, and an image forming apparatus. The electron emission element is formed from a semiconductor layer between an upper electrode and a lower electrode. An organic compound layer is formed by organic compounds adhering to the semiconductor surface of the semiconductor layer.

Other examples of apparatus using an electron emission element include Prior Art 13 (Japanese Patent Application Laid-open No. 2002-311684) and Prior Art 14 (Japanese Patent Application Laid-open No. 2004-327084).

Of the apparatus using electron emission elements referred to above, in recent years there has been much research into carbon nano-materials, including carbon nanotubes which have been widely researched, which suggests a high electron emission capability. For example, in Prior Art 10, it is disclosed that by prescribing the constituent elements at the ends of the carbon nanotubes, the durability of the carbon nanotubes can be improved. In addition, the electron emission element can be used in a non-contacting or contacting type of charging device.

However, carbon nano-materials are organic materials. Therefore, when used for electron emission in the atmosphere, as in electrophotography, the carbon nano-material itself is oxidized by oxygen atoms excited by the emitted electrons, and decomposes by combustion. There is also the problem that carbon nano-material is structurally very weak, so the required lifetime may not be achieved.

Also, when the electron emission elements having the MIS structure or MIM structure disclosed in Prior Art 9 or Prior Art 12 are used, there is the problem that sufficient electron emission cannot be obtained.

Technologies relating to the present invention are also disclosed in, e.g., Prior Art 15 (Japanese Patent No. 3,598,381), Prior Art 16 (Japanese Patent No. 3,119,431), Prior Art 17 (Japanese Patent Application Laid-open No. S62-052866).

SUMMARY OF THE INVENTION

With the foregoing in view, it is an object of the present invention to provide an electron emission element having a structure and constitution in which deterioration of the electron emission material itself is low.

Also, another object of the present invention is to provide an electron emission element having a structure and constitution that is compact, thin, and low cost, and capable of fitting into a multiple layered shape.

Furthermore, another object of the present invention is to provide a charging device that uses the electron emission element, that is capable of preventing hazard to the image carrier by obtaining electron emission at a level for which discharge products are not generated, and for which the deterioration of the electron emission material itself is low; a process cartridge that includes the charging device; and an image forming apparatus that includes the charging device or the process cartridge.

In an aspect of the present invention, (1) An electron emission element that uses a material with electron emission characteristics as electron emission means is provided. Boron nitride material is used as the electron emission material, and a metal material or a semiconductor material is used as a substrate for forming the boron nitride material.

(2) The boron nitride material is $Sp^3$-bonded boron nitride material.

(3) The $Sp^3$-bonded boron nitride material includes hexagonal system 5H or 6H crystals as the main crystalline form.

(4) The metal material that forms the substrate is flexible and ribbon-shaped.

(5) A composite substrate in which a metal layer is provided on an insulating material is used as the substrate.

(6) A composite substrate in which a semiconductor layer is provided on an insulating material is used as the substrate.

(7) A polymer film is used as the insulating material in the composite substrate.

(8) A polymer film having a film thickness in the range 50 μm to 3 mm is used as the insulating material in the composite substrate.

(9) The portion of the electron emission material is divided into a plurality of independent areas, and voltage supply means is provided capable of independently setting and applying a voltage to each of the areas.

(10) A plurality of projections with pointed tips is provided on the surface of the substrate, and the film thickness of the electron emission material formed on the substrate is 100 μm or less.

(11) A charging device that charges an object to be charged by applying charge thereto, wherein an electron emission element according to any of (1) through (10) is used as means for applying charge to the object to be charged.

(12) An image forming apparatus having at least an image carrier, charging means, developing means, transfer means, and cleaning means, wherein an electron emission element according to any of (1) through (10), or the charging device according to (11) is provided as the charging means.

(13) The charging means forms electrostatic latent images by applying charge to the image carrier.

(14) A process cartridge that includes charging means and at least one of an image carrier, developing means, transfer means, and cleaning means, that can be freely inserted into and removed from an image forming apparatus, wherein an electron emission element according to any of (1) through (10), or the charging device according to (11) is provided as the charging means.

(15) An image forming apparatus that forms images, having a process cartridge according to (14) above.

(16) An image forming apparatus that forms multi-color or color images, having a plurality of process cartridges according to (14) above.

(17) An image forming apparatus wherein the charging means of the process cartridge forms electrostatic latent images by applying charge to the image carrier.

In another aspect of the present invention, (1) An electron emission element is provided that uses $Sp^3$-bonded boron nitride having electron emission characteristics.

(2) The $Sp^3$-bonded boron nitride includes type 5H or 6H crystals as the main crystalline form.

(3) The $Sp^3$-bonded boron nitride is formed as a thin film on the surface of an electrically conducting material.

(4) The $Sp^3$-bonded boron nitride is made into powder form, brought into electrical contact with the surface of an electrically conducting material, and dispersed and fixed.

(5) A charging device having as charging means an electron emission element according to any of (1) through (4) above, wherein by applying a voltage between the electron emission element and an image carrier, the image carrier is charged by electrons emitted from the surface of the electron emission element or by ions formed by absorption of the electrons by molecules in the air.

(6) A protective film is provided on the surface of the electron emission element.

(7) The protective film is a thin film electrode.

(8) The image carrier is formed on an electrically conducting support member that is grounded at zero potential, and a bias voltage is applied between the electrically conducting support member and the thin film electrode on the electron emission element.

(9) The thin film electrode covers the entire surface of the element.

(10) Either, one of the single elements Au, Pt, Ir, Cs, Rh, or Ru, or an alloy of the single elements, or a mixture of the single element and the alloy is used as the material of the thin film electrode.

(11) The film thickness of the thin film electrode is within the range 3 nm to 40 nm.

(12) The drive voltage of the electron emission element is either an alternating current voltage or a pulse voltage.

(13) An electrically conducting member is disposed in the gap between the $Sp^3$-bonded boron nitride and the image carrier, to control the surface potential of the image carrier.

(14) An image forming apparatus having at least an image carrier, charging means that applies charge to the image carrier for forming the electrostatic latent image, developing means, transfer means, and cleaning means, wherein a charging device according to any of (5) through (13) above is used as the charging means.

(15) A process cartridge that includes charging means and at least one of an image carrier, developing means, transfer means, and cleaning means, that can be freely inserted into and removed from an image forming apparatus, wherein a charging device according to any of (5) through (13) above is used as the charging means.

(16) An image forming apparatus capable of forming color images, having a plurality of process cartridges according to (15) above.

BRIEF DESCRIPTION OF THE DRAWINGS

The above and other objects, features, and advantages of the present invention will become more apparent from the following detailed description taken with the accompanying drawings in which.

DESCRIPTION OF THE PREFERRED EMBODIMENTS

The following is a detailed explanation of the embodiments of the present invention with reference to the drawings.

Embodiment 1

First, an electron emission element as electron emission means included in the charging device according to the present embodiment is explained with reference to FIGS. 1A, 1B, 2A, and 2B.

Figure 1A:
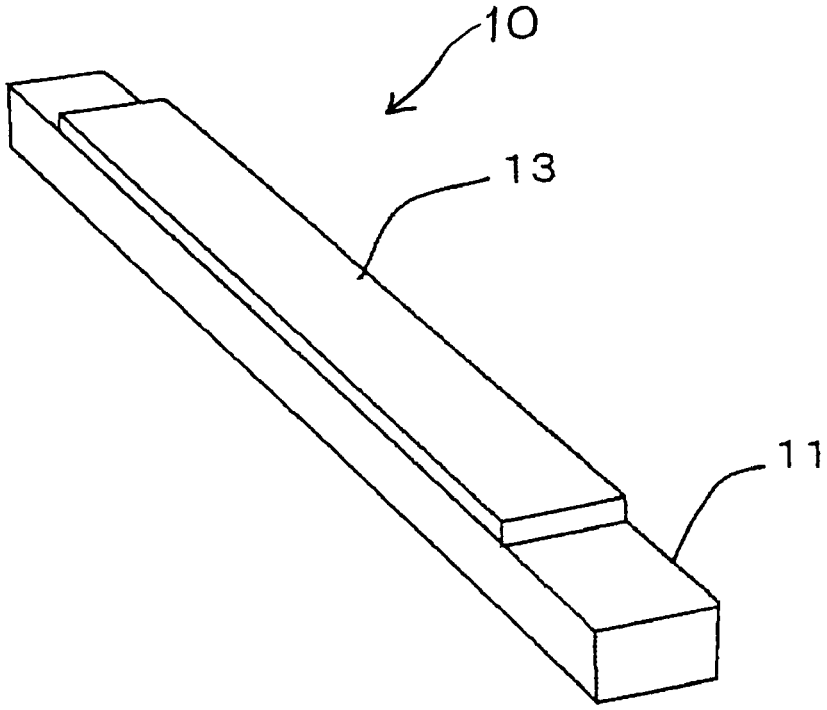
FIGS. 1A and 1B are diagrams showing the structure of the electron emission element according to embodiment 1 of the present invention.
Figure 1B:
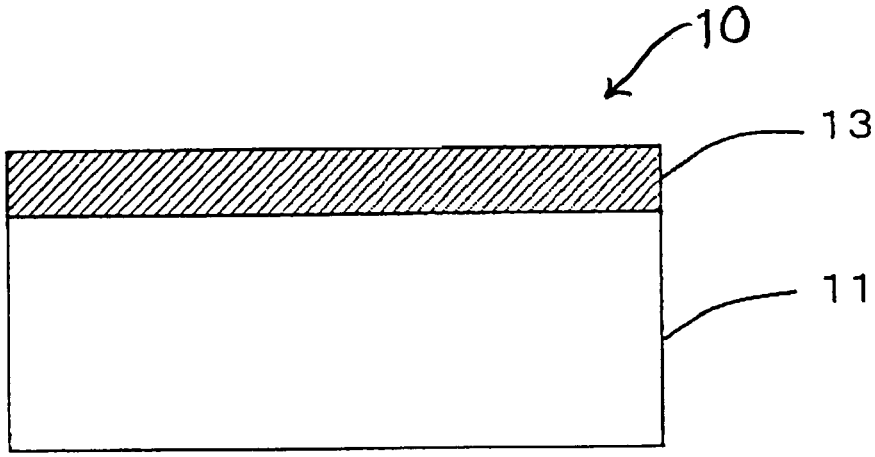

FIGS. 1A and 1B show an example of the structure of an electron emission element. FIG. 1A shows an external view of the electron emission element, and FIG. 1A shows a section through the electron emission element. An electron emission element 10 in FIGS. 1A and 1B is formed from a rectangular rod shaped substrate and metal material 11, on which a boron nitride thin film 13 is fixed.

Figure 2A:
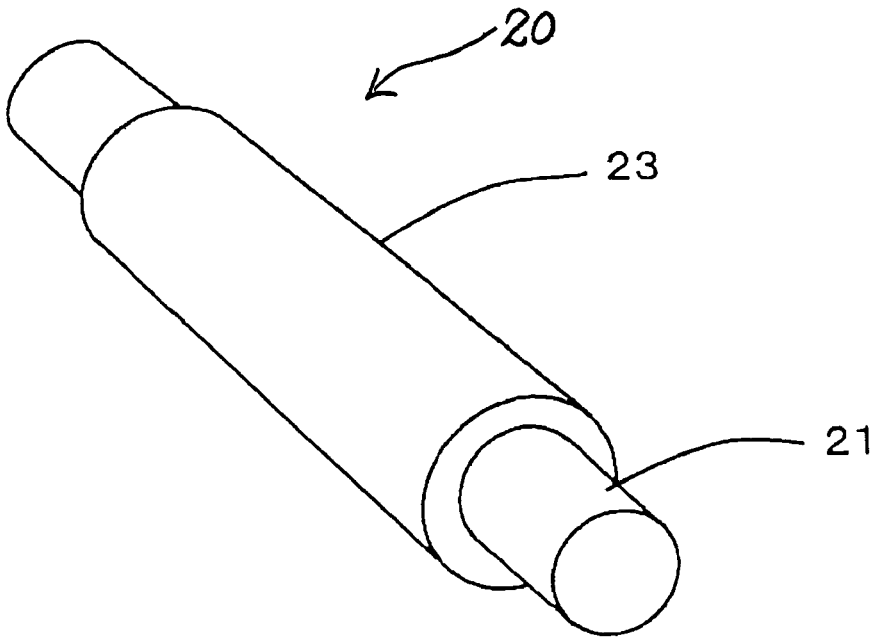
FIGS. 2A and 2B are diagrams showing the structure of another electron emission device according to embodiment 1.
Figure 2B:
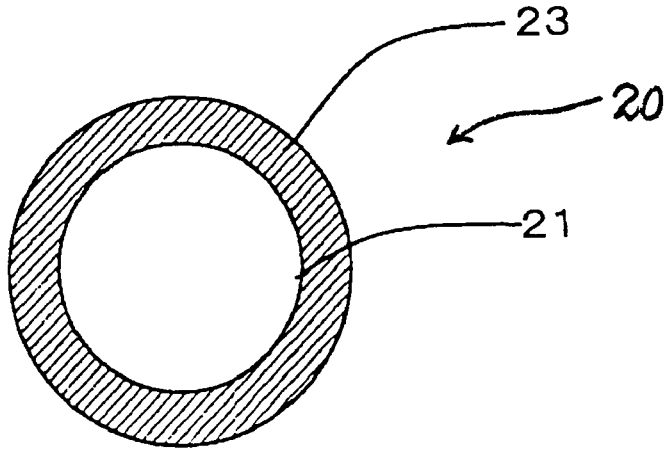

Also, FIGS. 2A and 2B show another example of the structure of an electron emission element. FIG. 2A shows an external view of the electron emission element, and FIG. 2B shows a section through the electron emission element. An electron emission element 20 in FIGS. 2A and 2B is formed from a wire shaped substrate and metal material 21, on which a boron nitride powder 23 is dispersed and fixed.

In the electron emission element 10 (or 20) shown in FIGS. 1A and 1B (or 2A and 2B), by applying a voltage from a power source that is not shown in the drawings to the substrate and metal material 11 (or 21), electrons are emitted from the boron nitride material 13 (or 23). At this time the metal material 11 (or 21) can be said to function as an electrode. By using the metal material 11 (or 21) as a substrate, as in this embodiment, there is no necessity to provide a separate member as an electrode. Therefore the number of manufacturing operations can be reduced, and a low cost electron emission element 10 (or 20) can be manufactured. In the present embodiment the metal material 11 (or 21) has a rectangular rod shape (or wire shape), but the present embodiment is not particularly limited to this shape. In other words, provided the material has the nature and shape of an electrically conducting metal, has a certain amount of stiffness, and can withstand the process temperature during manufacture, in particular the film making temperature when the boron nitride material 13 (or 23) is manufactured and deposited, it can be used. More specifically, Ni, Cr, Ni—Cr, W, Ta, Mo, Au, Ag, Pt, Cu, Al, Fe, and other metal materials can be used.

Electrons emitted from the electron emission element 10 (or 20) shown in FIGS. 1A and 1B (or 2A and 2B) adhere to gas molecules, for example oxygen, carbon dioxide, nitrogen, and water adhering to these molecules, generate negative ions, and the object to be charged can be charged by these ions.

Here, the reduction in ozone and oxides of nitrogen (NOx) when using this type of electron emission element 10 (or 20) is explained.

Normally, when charging using corona discharge, very large quantities of ozone and oxides of nitrogen (NOx) are generated. This is because the energy of the electrons discharged from the corona wire is 30 eV or higher. Therefore, as a result of dissociation of gas molecules (oxygen molecules, nitrogen molecules, and so on) due to electron impact, ozone or oxides of nitrogen (NOx) are generated. In fact the dissociation energy of a nitrogen molecule due to electron impact is 24.3 eV, and the dissociation energy of an oxygen molecule due to electron impact is 8 eV, so it is not unusual that the dissociation reaction occurs.

In contrast to this, in the case of the electron emission element 10 (or 20) shown in FIG. 1 (or FIG. 2) using boron nitride material, the energy of the electrons generated is about 6 eV, so the emitted electrons do not cause dissociation of the gas molecules, and neither oxides of nitrogen nor ozone is generated.

In this way, discharge products (ozone, NOx, and so on) are not generated. Therefore it is possible to prevent adhesion of discharge products on the object to be charged, which is the surface of the image carrier, oxidation of the surface of the image carrier by gas activated by the discharge, and the hazard of deterioration. In addition, deterioration such as combustion due to oxidation of the electron emission material itself does not occur, so charging can be carried out stably over a long period of time. Also, because of the low voltage, it is possible to obtain sufficient image carrier charging voltage in a short period of time. Further, as this is a non-contact charging method, deterioration due to adhesion of toner that remains after transfer or similar causes does not occur.

Next, the boron nitride material is explained.

As a result of diligent searching for electron emission materials by the eight inventors, it was found that in boron nitride produced under specific conditions, material with a surface shape that displays excellent field electron emission characteristics is formed, and that also has strong resistance to electric field strength. In other words, when boron nitride is deposited on the substrate by a gaseous phase reaction, by irradiating near the substrate with high energy ultra-violet light a boron nitride film is formed on the substrate. Also, on the surface of the film, boron nitride shaped with pointed tips nucleates and grows in the direction of the light in a self-organized manner at appropriate intervals. Electrons are easily emitted from this material by applying an electric field. Also, it was found that although a high level of current density is maintained compared with conventional electron emission materials, a very stable condition and performance could be maintained with no material deterioration, damage, or fall off.

In the boron nitride film material according to the present embodiment, it is necessary to irradiate with ultra-violet light in order that the surface shape is self-formed by the gaseous reaction to have the excellent electron emission characteristics. At this stage the reason for this is not necessarily clear, but the following may be considered. In other words, the formation of the surface shape by self-organization is understood to be a "Turing structure", as pointed out by Ilya Prigogine et al., which appears under certain conditions of competition between surface diffusion of precursor substances and surface chemical reactions. Here, it is considered that the ultra-violet light radiation is associated with the opto-chemical promotion of both, and affects the regular distribution of the initial nucleation points. The growth reaction on the surface is promoted by the ultra-violet light radiation, but this means that the reaction speed is proportional to the light strength. Assuming the initial nuclei have a hemispherical shape, near the apexes the light strength is strong, which promotes growth. In contrast, around the peripheral edges the light strength is weak, so growth is slower. This is considered to be one reason for the formation of surface features with pointed tips. In any case, ultra-violet radiation plays a very important role, and it cannot be denied that this is a very important point.

Next, the conditions for the vapor reaction to obtain $Sp^3$-bonded boron nitride film with excellent electron emission characteristics as used in the present embodiment is explained.

Figure 3:
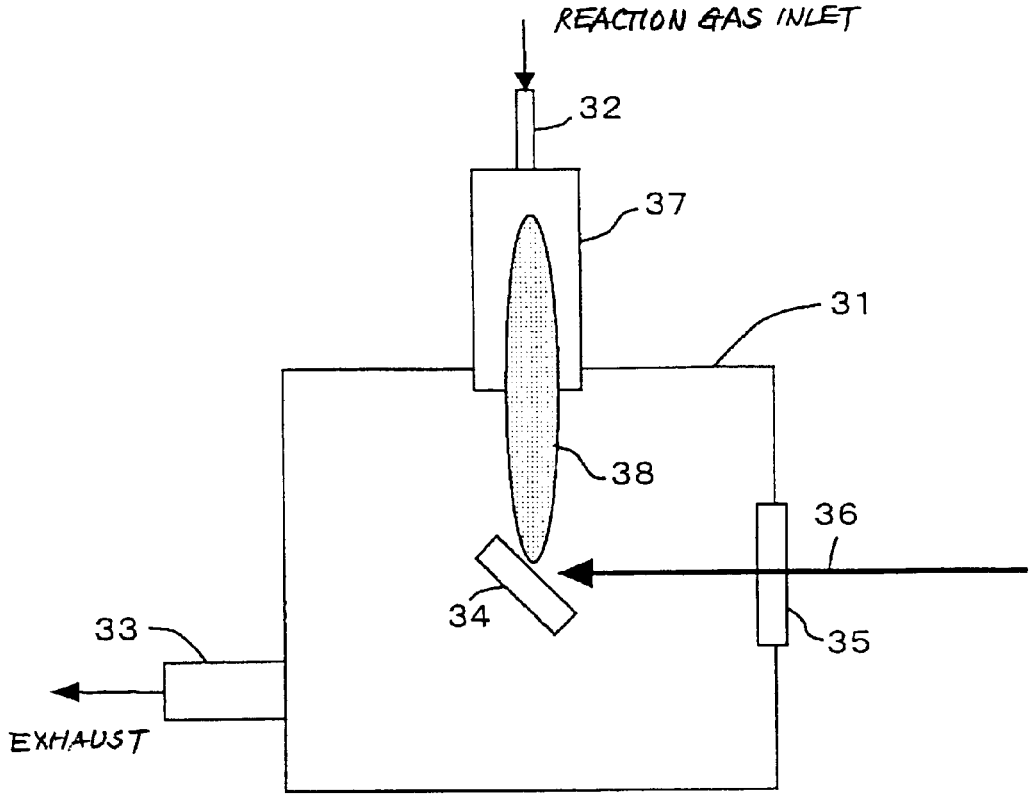
FIG. 3 is a diagram showing the schematic structure of a reaction device used when forming the boron nitride material of the electron emission element according to the present invention.

The reaction vessel of the forming device used is a chemical vapor deposition (CVD) reaction vessel with the structure shown in FIG. 3. In other words, in FIG. 3, a reaction vessel 31 includes a gas inlet 32 for introducing reaction gas and dilution gas, and a gas outlet 33 for discharging the introduced reaction and other gases out of the vessel. The gas outlet 33 is connected to a vacuum pump that is not shown on the drawings, to maintain a pressure lower than atmospheric pressure. A boron nitride deposition substrate 34 is disposed in the gas flow path within the vessel. An optical window 35 is provided in a part of a wall of the reaction vessel 31 facing towards the substrate 34. An excimer ultra-violet light laser device, which is not shown on the drawings, is disposed so that ultra-violet light 36 is radiated towards the substrate 34 via the optical window 35.

The reaction gas introduced into the reaction vessel 31 via the gas inlet 32 is excited by the ultra-violet light 36 radiated onto the surface of the substrate 34. A source of nitrogen and a source of boron in the reaction gas react in the gaseous phase to form $Sp^3$-bonded boron nitride having the general formula BN, and 5H and 6H poly type structures. The boron nitride is then deposited to form the film. The pressure within the reaction vessel in this case can be within the range 0.001 to 760 Torr. Also, it has been shown by tests that the temperature of the substrate 34 set in the reaction space can be within the range room temperature to 1,300° C. However, to obtain the target reaction product with high purity, it is preferable to use low pressure and high temperature. When irradiating the surface of the substrate and the nearby space with ultra-violet light 36, plasma may also be used in conjunction with the ultra-violet light 36 in one aspect of an embodiment. FIG. 3 shows this form with a plasma torch 37. The reaction gas inlet 32 and the plasma torch 37 are set integrally facing towards the substrate 34, so that reaction gas and plasma 38 are directed towards the substrate 34.

In the present embodiment, the $Sp^3$-bonded boron nitride film is formed using the reaction vessel 31 as described above, but the following provides further explanation based on the drawings and specific examples. However, the examples described below are provided to assist in the understanding of the present embodiment, and the present embodiment is not limited by these examples. In other words, an aim of the present embodiment is to form in a self-forming manner a surface shape that has excellent field electron emission characteristics by a gaseous phase reaction. A method of manufacturing an $Sp^3$-bonded boron nitride film having excellent electron emission characteristics is provided. Also, an invention for use as an electron emission material is provided. As long as the objects are achieved, the reaction conditions and so on can be changed or set as appropriate.

The structure of the $Sp^3$-bonded boron nitride obtained in this way is, for example, $Sp^3$-bonded 5H—BN material, or $Sp^3$-bonded 6H—BN material. In other words, $Sp^3$-bonded boron nitride having the general formula indicated by BN, and the hexagonal system 5H or 6H polytype structures, as disclosed in for example Prior Art 15, is known.

The inventors of the present invention diligently studied whether this type of $Sp^3$-bonded 5H—BN material or $Sp^3$-bonded 6H—BN material could be applied to electron emission elements that can be used in charging devices and the like for the image carrier of an image forming apparatus. As a result it was discovered that by using $Sp^3$-bonded 5H—BN material or $Sp^3$-bonded 6H—BN material as electron emission material, it is possible to charge an image carrier, and the present invention was completed.

In particular, $Sp^3$-bonded 5H—BN material has bonding properties that are the same as diamond, and is a type of boron nitride whose hardness is next to that of diamond. Boron nitride is a material that is used in furnaces, for example, and has outstanding resistance to heat and chemical substances. Therefore it can be said that this is an electron emission material with unprecedented durability and resistance to high loads.

When manufacturing an electron emission element using this type of boron nitride, a thin film of this boron nitride material of thickness 100 μm or less is formed as a surface layer on the electrically conducting material (the metal material forming the electrode described above, or similar). Therefore compared with the case of using a single crystal that requires time for manufacture and whose cost is high, the manufacturing time can be reduced while maintaining the electron emission characteristics to a certain extent, the material cost is reduced, so the cost can be reduced.

Also, by pulverizing the boron nitride into powder form using physical means such as a ball mill, crusher, or similar, and fixing the boron nitride in an electrically conducting manner to the electrically conducting portion, the manufacturing process can be simplified and the cost reduced compared with the case where a single crystal of boron nitride is used.

Production Conditions Example 1

Next, an example of the conditions for producing $Sp^3$-bonded boron nitride is provided.

Using the reaction vessel 31 shown in FIG. 3, diborane at a flow rate of 10 sccm and ammonia at a flow rate of 20 sccm was introduced into the flow of diluting gas which was a mixture of argon at a flow rate of 2 SLM and hydrogen at a flow rate of 50 sccm, introduced from the reaction gas inlet 32. At the same time, the environment was maintained at a pressure of 30 Torr by extracting the gas from the gas outlet 33 using a vacuum pump, which is not shown in the drawings. The environment was maintained at a temperature of 800° C. by heating, and excimer laser ultra-violet light 36 was radiated towards a silicon substrate 34. After 60 minutes of production time, the target film was obtained. Analysis of the produced thin film by the X-ray diffraction method showed that the material was a hexagonal system crystal, with 5H type polytype structure by $Sp^3$-bonding. The lattice constants were, a=2.52 Å, c=10.5 Å.

The surface shape of the obtained thin film was examined in a scanning electron microscope. The results showed that the characteristic surface shape, in which the surface was covered with conical shaped projections (from 0.001 μm to several tens of microns in length), at the tips of which electric fields can easily concentrate, had been formed in a self-organized manner. To investigate the field electron emission characteristics of the thin film, a voltage was applied between an electrode and the thin film in a vacuum. The electrode was a 1 mm diameter cylindrical shaped metal electrode that was separated from the surface of the thin film by 30 m. The electron emission quantity was measured. The results showed that at an electric field strength of 15 to 20 (V/μm), an increase in current density was observed. At 20 (V/μm) saturation was measured at the limiting current value (1.3 $A/cm^2$ equivalent) of the high voltage power source for measurement.

Also, at this time variations of the current value with time were measured. In about 15 minutes, some fluctuations in the current value were observed, but the average current value was virtually maintained. Therefore no reduction in the current value due to material degradation was seen, so it was confirmed that this material is a stable material.

Production Comparison Example 1

For comparison, the electron emission characteristics of the portion of a thin film that was not irradiated with ultra-violet light were investigated. The thin film was made at the same time and under the same conditions as production example 1, except that there was no irradiation with ultra-violet light. The results showed that the threshold value of electric field strength for start of electron emission was 42 (V/μm), which is much higher than the 15 (V/μm) obtained for the portion that was irradiated with ultra-violet light. Also, when this portion was examined with a scanning electron microscope, damage and peeling of the thin film was observed, that was caused by the electron emission. On the other hand, this kind of damage was not observed after the field electron emission test in the portion having the projections in the surface shape that grew under ultra-violet irradiation.

Production Conditions Example 2

Next, another example of production conditions for $Sp^3$-bonded boron nitride is described.

Using the reaction vessel 31 shown in FIG. 3, diborane at a flow rate of 10 sccm and ammonia at a flow rate of 20 sccm was introduced into the flow of diluting gas which was a mixture of argon at a flow rate of 2 SLM and hydrogen at a flow rate of 50 sccm, introduced from the reaction gas inlet 32. At the same time, the environment was maintained at a pressure of 30 Torr by extracting the gas from the gas outlet 33 using a vacuum pump, which is not shown in the drawings. An RF plasma 38 of output 800 W and frequency 13.56 MHz was generated from the plasma torch 37. The environment was maintained at a temperature of 900° C. by heating, and excimer laser ultra-violet light 36 was radiated towards a silicon substrate 34. After 60 minutes of production time, the target film was obtained. Analysis of the product was carried out in the same way as production conditions example 1, which showed that the material was a hexagonal system crystal, with 5H type polytype structure by $Sp^3$-bonding. The lattice constants were, a=2.5 Å, c=10.4 Å.

The surface shape of the obtained thin film was examined in a scanning electron microscope. The results showed that the characteristic surface shape, in which the surface was covered with conical shaped projections (from 0.001 μm to several microns in length), at the tips of which electric fields can easily concentrate, had been formed in a self-organized manner. To investigate the field electron emission characteristics of the thin film, a voltage was applied between an electrode and the thin film in a vacuum. The electrode was a 1 mm diameter cylindrical shaped metal electrode that was separated from the surface of the thin film by 40 μm. The electron emission quantity was measured. The results showed that at an electric field strength of 18 to 22 (V/μm), an increase in current density was observed. At 22 (V/μm) saturation was measured at the limiting current value (1.3 $A/cm^2$ equivalent) of the high voltage power source for measurement. In other words, it was confirmed that stable material was obtained, similar to production conditions example 1.

As stated above, the $Sp^3$-bonded boron nitride film ($Sp^3$-bonded 5H—BN) with excellent electron emission characteristics used in the electron emission element according to the present embodiment has a surface shape with excellent field electron emission characteristics. In other words, the surface has a characteristic structure formed in a self-organized manner, with projections with pointed tips.

Also, using the above method, $Sp^3$-bonded boron nitride films having the surface shape with excellent electron emission characteristics can be manufactured. In this way, the threshold value for electron emission is low and the current density is high. Also, the electron emission life is long, so this is an extremely good new material, ideal as an electron emission material, that does not require any special processing means or processes for manufacture.

The range of application of the electron emission element using an $Sp^3$-bonded boron nitride film with excellent electron emission characteristics as described above is very diverse and broad, as described later. It is expected that it will contribute greatly to the development of industry in the future.

Embodiment 2

Figure 4:
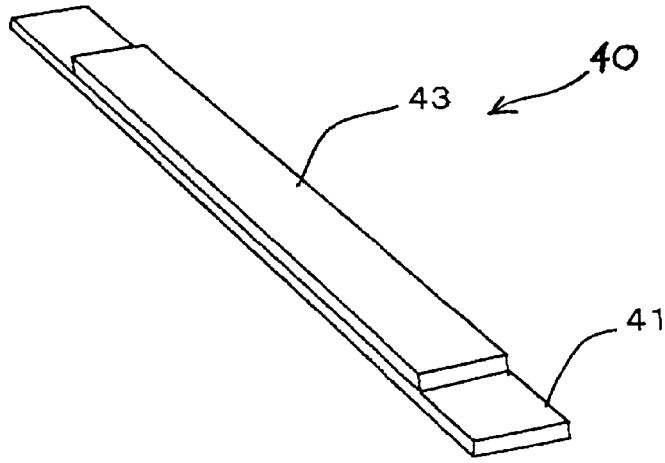
FIG. 4 is an isometric diagram showing the electron emission element according to embodiment 2 of the present invention.

FIG. 4 shows the structure of an electron emission element according to the present embodiment. An electron emission element 40 shown in FIG. 4 has the characteristic that a substrate and metal material 41 is ribbon shaped plate whose thickness is comparatively thin. A thin film 43 of boron nitride is formed on the ribbon shaped metal material 41. Also, if powder of the same material is dispersed and fixed to form the thin film 43 of boron nitride, the same performance and function are obtained.

In the present embodiment, the substrate and metal material 41 is ribbon shaped plate whose thickness is comparatively thin. Therefore, it can be deformed (twisted, curved, and so on) in accordance with the shape of the image carrier (normally a drum shape), which is the object to be charged. In this way, the area in opposition to the image carrier can be made wider, so by increasing the area that exhibits the charging function, the charging efficiency is improved. This means that high speed printing can be carried out by an image forming apparatus. Furthermore, another effect of the present embodiment is that space can be saved when assembled.

Also, by deforming the ribbon shaped metal material 41 in advance, and then forming the thin film 43 of boron nitride on the metal material 41, even greater deformations can be achieved.

Provided the ribbon shaped metal material 41 is electrically conducting, has a certain amount of form ability and stiffness, and can withstand the temperature during manufacture, in particular the temperature at which the boron nitride thin film 43 is formed and deposited, the material may be used. More specifically, Ni, Cr, Ni—Cr, W, Ta, Mo, Au, Ag, Pt, Cu, Al, Fe, and other metal materials can be used.

The emission of electrons from the electron emission element 40 according to the present embodiment, the charging process by generation of negative ions, the reduction in ozone and oxides of nitrogen, the method of manufacturing the $Sp^3$-bonded boron nitride film that constitutes the electron emission element, the production conditions, and so on, are the same as described above for Embodiment 1, and the same effect can be obtained.

Embodiment 3

Figure 5A:
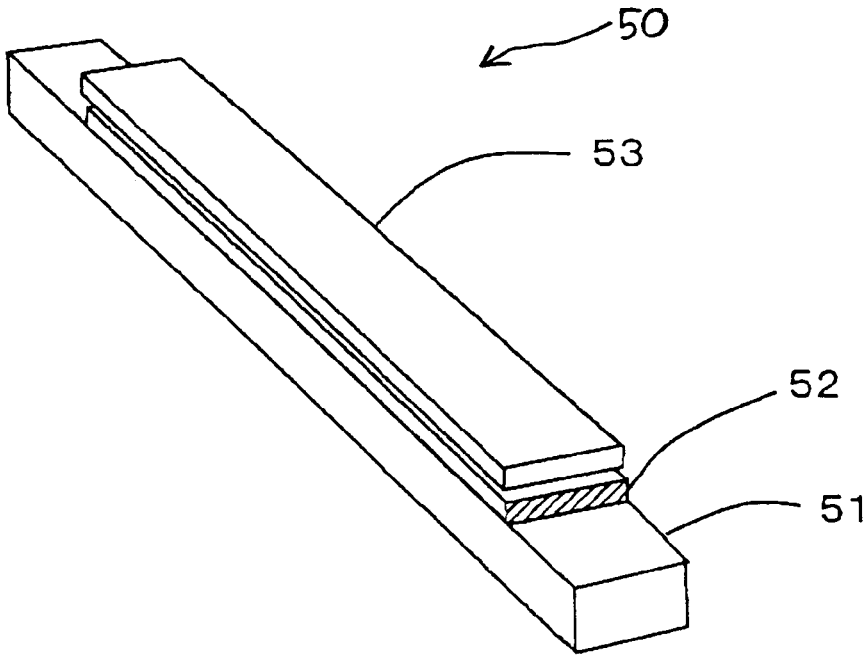
FIGS. 5A and 5B are diagrams showing the structure of the electron emission element according to embodiments 3 and 4 of the present invention.
Figure 5B:
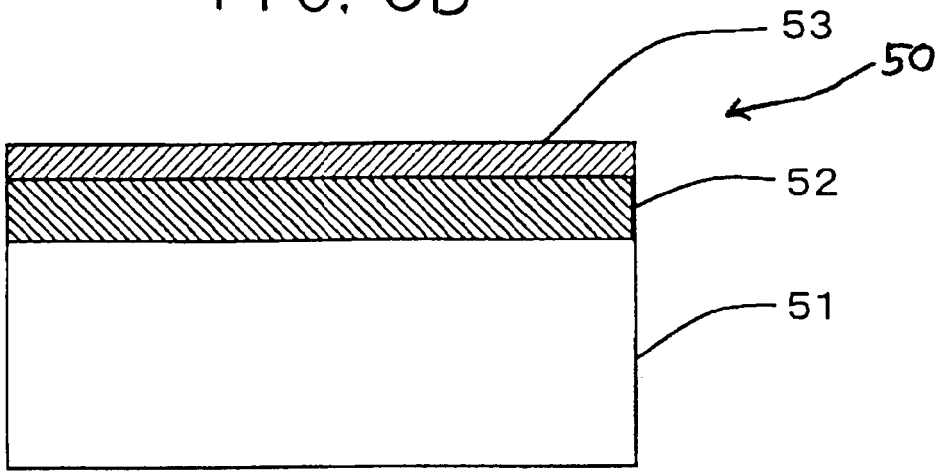

FIGS. 5A and 5B show the structure of an electron emission element according to the present embodiment. FIG. 5A shows an external view of the electron emission element, and FIG. 5B shows a cross-section through the electron emission element.

The electron emission element 50 shown in FIGS. 5A and 5B uses a composite substrate in which a metal layer 52 is provided on an insulating material 51 as substrate for forming the boron nitride material. A thin film 53 of boron nitride is formed on the metal layer 52. Also, if powder of the same material is dispersed and fixed to form the thin film 53 of boron nitride, the same performance and function are obtained.

Quartz glass, pyrex (registered trademark) glass, borosilicate glass, soda-lime glass, a glass substrate on which a $SiO_2$ film is formed to block impurities from the surface, and ceramic substrates such as alumina, magnesia, and so on, may be used as the insulating material 51. Common electrically conducting materials may be used for the metal layer 52, for example, metals such as Ni, Cr, Au, Mo, W, Pt, Ti, Al, Cu, Pd, and so on, or alloys such as Ni—Cr, and so on. The method of manufacturing the metal layer 52 may be a gaseous phase film forming method such as vacuum vapor deposition, ion plating, cluster ion beam vapor deposition, sputtering, magnetron sputtering, or the wet printing method using the screen method or inkjet method, and so on. Also, it is preferable that the film thickness d of the metal layer 52 be within the range 100 Å to 10 μm from considerations of cost, resistance of the metal layer, peeling due to stresses within the metal layer, and so on.

By using a composite substrate that includes an insulating material 51 suitable for forming into a long large area plate on which the metal layer 52 is provided as the substrate for the boron nitride material in this way, it is possible to manufacture an electron emission element 50 that is long and has a large area. Also, the range of substrate materials that can be selected is broadened, so it is possible to reduce the manufacturing cost. Furthermore, boron nitride material with unprecedented high efficiency electron emission characteristics is used as the electron emission material.

The emission of electrons from the electron emission element 50 according to the present embodiment, the charging process by generation of negative ions, the reduction in ozone and oxides of nitrogen, the method of manufacturing the $Sp^3$-bonded boron nitride film that constitutes the electron emission element, the production conditions, and so on, are the same as described above for Embodiment 1, and the same effect can be obtained.

Embodiment 4

The structure of the electron emission element according to the present embodiment is the same as that of Embodiment 3 described above, so a drawing is not included. In the present embodiment, a composite substrate is used, in which a semiconductor layer is provided on an insulating material, as the substrate on which the boron nitride is formed. A thin film of boron nitride material is formed on the semiconductor layer. Also, if powder of the same material is dispersed and fixed to form the thin film of boron nitride, the same performance and function are obtained.

Quartz glass, pyrex (registered trademark) glass, borosilicic acid glass, soda-lime glass, a glass substrate on which a $SiO_2$ film is formed to block impurities from the surface, and ceramic substrates such as alumina, magnesia, and soon, may be used as the insulating material. The material of the semiconductor layer may be Si, Ge, GaAs, GaN, GaP, AlN, BN, or other group IV or group III-V semiconductor materials. Their structural form may be crystalline, polycrystalline, or amorphous, and so on.

The method of manufacturing the semiconductor layer may be a gaseous phase film forming method such as vacuum vapor deposition, ion plating, cluster ion beam vapor deposition, sputtering, magnetron sputtering, epitaxial growth, and so on. Also, it is preferable that the film thickness of the semiconductor layer be within the range 100 Å to 10 μm from considerations of cost, peeling due to stresses within the semiconductor layer, and so on.

By using a composite substrate that includes an insulating material suitable for forming into a long large area plate on which the semiconductor layer is provided as the substrate for the boron nitride material in this way, it is possible to manufacture an electron emission element that is long and has a large area. Also, the range of substrate materials that can be selected is broadened, so it is possible to reduce the manufacturing cost. Furthermore, boron nitride material with unprecedented high efficiency electron emission characteristics is used as the electron emission material.

Of the above mentioned semiconductor materials, the bonding of Si, Ge, GaN, AlN, or BN to the boron nitride material is particularly good. This is a result of diffusion of boron atoms in the boron nitride material into the semiconductor material, or because the lattice constants of both materials are close. Therefore they are very suitable for the electron emission element according to the present embodiment. Also, to make the semiconductor layer function as it is as an electrode, the resistance value may be controlled by doping with an impurity, in the usual manner for semiconductor processes. If doping is not carried out, the semiconductor layer will function only as a base layer for the boron nitride material. In this case it is necessary to provide an electrically conducting layer as the electrode below the semiconductor layer. For this type of semiconductor layer, the metal materials referred to above and electrically conducting oxides (ITO, $In_2O_3$, $SnO_3$, and so on) are preferable.

The emission of electrons from the electron emission element according to the present embodiment, the charging process by generation of negative ions, the reduction in ozone and oxides of nitrogen, the method of manufacturing the $Sp^3$-bonded boron nitride film that constitutes the electron emission element, the production conditions, and so on, are the same as described above for Embodiment 1, and the same effect can be obtained.

Embodiment 5

Figure 6:
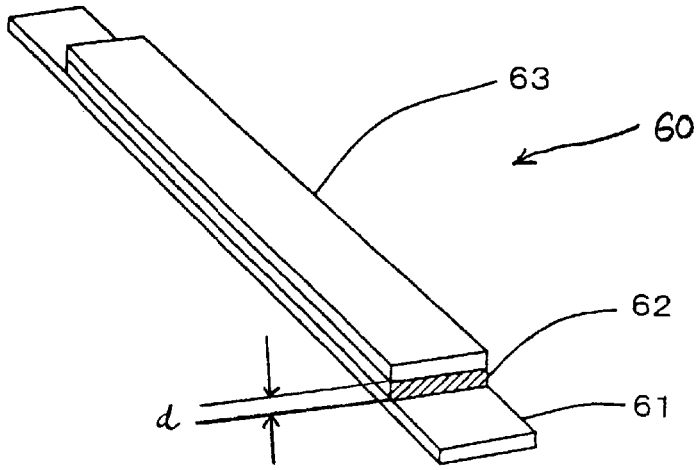
FIG. 6 is an isometric diagram showing the electron emission element according to embodiments 5 and 7 of the present invention.

FIG. 6 shows an external view of the electron emission element according to the present embodiment. The electron emission element 60 uses a composite substrate in which an electrode layer (metal layer or semiconductor layer) 62 is provided on an insulating material 61 as the substrate on which boron nitride material is formed. A characteristic of the present embodiment is that a composite substrate using a polymer film as the insulating material 61 is used. In other words, the electron emission element 60 includes a thin film 63 of boron nitride material formed on the electrode layer 62 provided on the polymer film 61. Also, if powder of the same material is dispersed and fixed to form the thin film 63 of boron nitride, the same performance and function are obtained.

In the present embodiment, a composite substrate using the polymer film 61 as the insulating material of the formed substrate is used. Therefore, it can be freely deformed (twisted, curved, and so on) in accordance with the shape of the image carrier (normally a drum shape), which is the object to be charged. In this way, the area in opposition to the image carrier can be made wider, so by increasing the area that exhibits the charging function, the charging efficiency is improved. This means that high speed printing can be carried out by an image forming apparatus. Furthermore, space can be saved, so the system as a whole can be made more compact. In addition, the restrictions on installation location of the charging device become fewer, the freedom of layout of the system improves, and the design can be simplified. Also, during assembly the element can be deformed a certain amount, so it is effective for reducing the number of assembly operations. Also, if the polymer film 61 is manufactured using a pre-designed form, electron emission elements with arbitrary shapes can be manufactured, which has significant benefits for assembly and system layout.

The method of manufacturing the electrode layer 62 may be a gaseous phase film forming method such as vacuum vapor deposition, ion plating, cluster ion beam vapor deposition, sputtering, magnetron sputtering, or the wet printing method using the screen method or inkjet method, and so on. Also, it is preferable that the film thickness d of the electrode layer 62 be within the range 100 Å to 10 μm from considerations of cost, resistance of the electrode layer, peeling due to stresses within the electrode layer 62, and so on.

Furthermore, by using polymer film 61 as the insulating material of the substrate, long, large area electron emission elements can be manufactured. Also the range of selection of substrate materials is broadened, so it is possible to reduce the manufacturing cost. In particular, during manufacture feeding the substrate to the apparatus can be carried out by the roll to roll system, rather than the sheet feed system, so production can be continuous, and the cost reduction effect can be continuous. Furthermore, boron nitride material with unprecedented high efficiency electron emission characteristics is used as the electron emission material.

The material used as the polymer film 61 may be polyimide, polyamideimide, polybenzoimidazole, polyarylate, polycarbonate, polysulfone, polyphenylene ether, polyethylene terephthalate, polyphenylene sulfide, polytetrafluoroethylene, and so on. Furthermore, when forming the electrode layer 62 the vacuum film forming method is sometimes used. However, in this case, the quality of the electrode layer may degrade due to off-gassing from the polymer film 61, or in some cases the electrode layer may peel, so it is not possible to form the layer. As a measure against this off-gassing and as a measure against gas permeability (or inclusion of gas that contains water vapor) of the polymer film 61, providing a gas barrier layer on the polymer film 61 is effective. In organic thin films such as $SiO_2$, SiNx, SiON, SiC, SiCO, DLC, and so on are effective as gas barrier layers.

Also, metals such as Ni, Cr, Ni—Cr, W, Ta, Mo, Au, Ag, Pt, Cu, Al, Fe, Pd, Ti, or the semiconductor materials referred to above may be used in the electrode layer 62.

The emission of electrons from the electron emission element 60 according to the present embodiment, the charging process by generation of negative ions, the reduction in ozone and oxides of nitrogen, the method of manufacturing the $Sp^3$-bonded boron nitride film that constitutes the electron emission element, the production conditions, and so on, are the same as described above for Embodiment 1, and the same effect can be obtained.

Embodiment 6

Figure 7A:
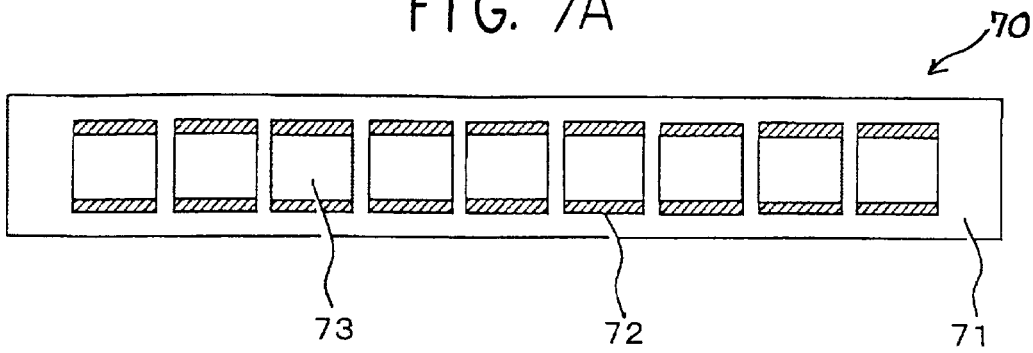
FIGS. 7A and 7B are diagrams showing the structure of the electron emission element according to embodiment 6 of the present invention.
Figure 7B:
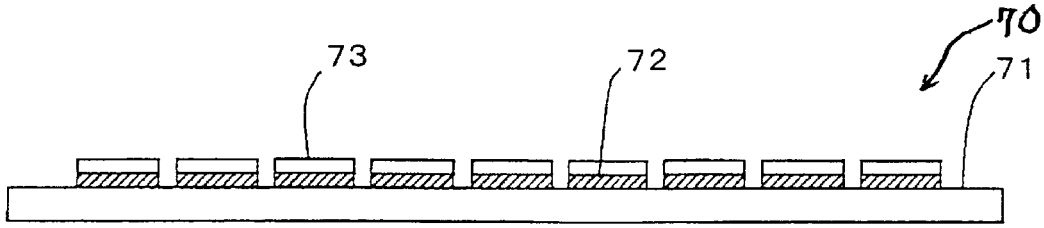

FIGS. 7A and 7B show the electron emission element according to the present embodiment. FIG. 7A shows a plan view of the electron emission element, and FIG. 7B shows a section through the electron emission element.

The electron emission element 70 shown in FIGS. 7A and 7B includes a composite substrate in which a plurality of separate and independent electrode layers 72 is provided on an insulating material 71 as the substrate. A plurality of separate and independent boron nitride material 73 is formed corresponding to the electrode layers 72 respectively. Also, if powder of the same material is dispersed and fixed to form the thin film 73 of boron nitride, the same performance and function are obtained. In FIGS. 7A and 7B, the plurality of boron nitride material 73 is formed with each portion separate and independent. However, if the resistance of the boron nitride material 73 is high, it may be formed as a continuous thin film. The electrode layer 72 is formed as a plurality of separate and independent portions, so adjoining bits are electrically isolated from each other, so the operation of the element is not affected. In this case, the process of separating the boron nitride material 73 (normally, photolithography and etching processes are used) is not required, so the manufacturing cost can be reduced.

Next, the operation and effect of this electron emission element 70 is explained.

In the electron emission element 70, the electron emission material part that includes the thin film 73 of boron nitride material and the electrode layer 72, is separated into a plurality of independent areas (dots). Voltage supply means capable of independently setting and applying a voltage to each area (dot) is provided. The voltage supply means includes a power supply system that applies a voltage to the electrode layer 72 of each area (dot), and a switching element that selects the dots to which a voltage is applied. However, the voltage supply means is not shown on the drawings.

The electron emission material side of the electron emission element 70 is disposed in opposition to an image carrier, which is the object to be charged. By independently setting and applying a voltage to each area (dot) by the voltage supply means that is not shown in the drawings, it is possible to charge or not charge the image carrier in one dot units, so it is possible to directly form the electrostatic latent image on the image carrier when charging. In other words, the electron emission element 70 can combine both image carrier charging means and latent image forming means. In this way, a light exposure device to form the latent image on an opto-semiconductor photosensitive member, which is the image carrier, is not required, so the cost of the image forming device can be reduced.

More specifically, the plurality of separate and independent electron emission material portions of the electron emission element 70 is disposed in the axial direction of the image carrier, over a length of, for example, 300 mm, at a density of 600 dpi. To each electron emission material portion, a selection signal that selects the dot in the position corresponding to the image, and an operation signal corresponding to the charge quantity for that dot is applied. As a result, electrons are emitted in accordance with the signals, and an area corresponding to one dot of the image carrier in opposition can be charged. Also, locations where a voltage was not applied to the electron emission material portion are not charged. Therefore, charged and uncharged areas are formed on the image carrier, and these form the electrostatic latent image. In other words, a charging device that includes the electron emission device can also serve as the latent image forming means, and function as a writing device, that writes the electrostatic latent image onto the image carrier.

Also, in this case, preferably voltage application means is provided, that applies a voltage to the plurality of separate and independent electron emission material portions (minute charging means) so that the same quantity of charge is provided to the image carrier. In other words, when directly forming the latent image using a plurality of minute charging means, if the voltage of each charging means is not equal, it is not possible to obtain high quality images. Therefore it is necessary to control so that the charge provided by each charging means corresponding to one picture element is the same. In this way, the voltages are equal, and high image quality can be obtained.

Quartz glass, pyrex (registered trademark) glass, borosilicate glass, soda-lime glass, a glass substrate on which a $SiO_2$ film is formed to block impurities from the surface, and ceramic substrates such as alumina, magnesia, and so on, may be used as the insulating material 71 used in the substrate of the electron emission element 70.

Common electrically conducting materials may be used for the metal layer 72, for example, metals such as Ni, Cr, Au, Mo, W, Pt, Ti, Al, Cu, Pd, and so on, or alloys such as Ni—Cr, and so on. The method of manufacturing the electrode layer 72 may be a gaseous phase film forming method such as vacuum vapor deposition, ion plating, cluster ion beam vapor deposition, sputtering, magnetron sputtering, or the wet printing method using the screen method or inkjet method, and so on. Also, it is preferable that the film thickness d of the metal layer 72 be within the range 100 Å to 1 μm from considerations of cost, resistance of the metal layer, peeling due to stresses within the metal layer, and so on.

Embodiment 7

The structure of the electron emission element according to the present embodiment is the same as that of Embodiment 6 described above, so a drawing is not included. The present embodiment uses a composite substrate in which an electrode layer (metal layer or semiconductor layer) 62 is provided on an insulating material 61 as the substrate on which boron nitride material is formed, the same as shown in FIG. 6. However, a characteristic of the present embodiment is that a composite substrate using a polymer film of film thickness 50 μm to 2 mm as the insulating material 61 is used.

The use of polymer film as the substrate gives freedom of deformation. However, if the polymer film is too thin, warping and curling of the polymer film can be caused by stresses due to the electrode layer or the boron nitride material formed on the polymer film. Therefore it may not be possible to maintain the flatness of the operation surface. Depending on the circumstances, dimensional deformation (contraction) of the polymer film itself could be caused by the stresses. This can cause problems of positional alignment of the upper layers, which are the functional layers. In particular, as in Embodiment 6 described above, if forming with an element density of 600 dpi or greater, the pattern of the electrode layer 72 and the pattern of the boron nitride layer may not coincide. Also, peeling of the upper layers can occur due to deformation of the substrate other than shrinkage of the substrate, which can cause the problem that the element cannot be formed. Therefore, by making the polymer film thickness equal to or greater than 50 μm, as in the present embodiment, dimensional deformation of the substrate can be kept within the range that no problem is caused in practice with a density of 600 dpi. Furthermore, for warping of the substrate, if the thickness is 100 μm or greater, warping of the substrate can be kept within the range that no problem is caused in practice. On the other hand, if the thickness of the polymer film is 3 mm or greater, the abovementioned problems do not occur. However, in this case the advantages of using a film are lost. The advantages of using a film are (1) a certain amount of deformation is possible, and (2) after manufacturing the element using a large area substrate as motherboard, the element can be freely cut to an arbitrary shape, and so on. The boron nitride material with unprecedented high efficiency electron emission characteristics is as described in Embodiment 1.

The material used as the polymer film may be polyimide, polyamideimide, polybenzoimidazole, polyarylate, polycarbonate, polysulfone, polyphenylene ether, polyethylene terephthalate, polyphenylene sulfide, polytetrafluoroethylene, and so on. Furthermore, as a measure against off-gassing and as a measure against gas permeability (or inclusion of gas that contains water vapor) of the polymer film itself, providing a gas barrier layer on the polymer film is effective. Inorganic thin films such as $SiO_2$, SiNx, SiON, SiC, SiCO, DLC, and so on are effective as gas barrier layers.

Embodiment 8

Figure 8:
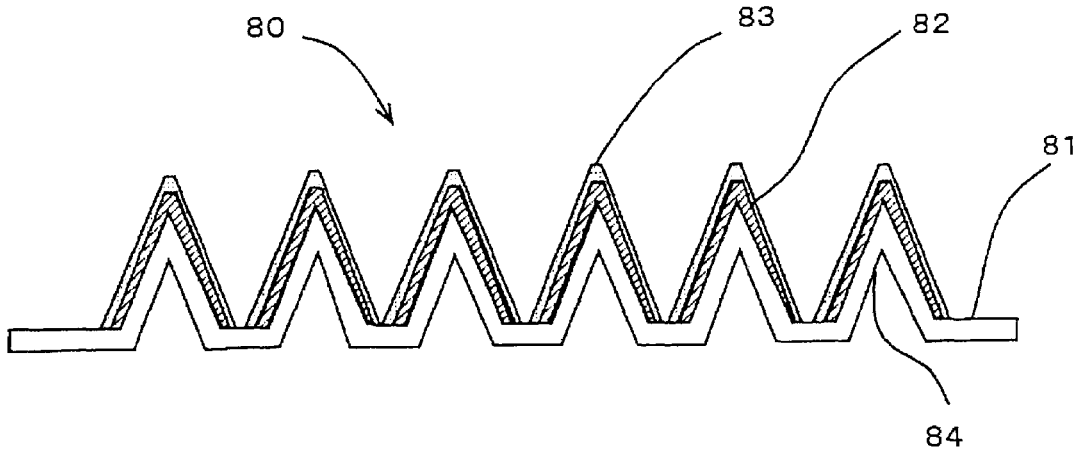
FIG. 8 is a section view showing the schematic structure of the electron emission element according to embodiment 8 of the present invention.

FIG. 8 shows the structure of the electron emission element according to the present embodiment. In the electron emission element 80, a plurality of projections 84 with pointed tips is provided on the surface of a substrate 81. On these projections 84, electrode material 82 is formed (with a film thickness of about 0.2 to 5 μm), on top of which electron emission material 83 is formed to a film thickness of 100 μm or less. By adopting this structure, even if the electron emission material (boron nitride, or similar) does not have the pointed projections, electric fields concentrate at the tips of the projections provided on the substrate 81, so electron emission is promoted. Also, coupled with the negative electron affinity (NEA) characteristics of the material itself, it is possible to achieve a field electron emission element 80 with unprecedented high efficiency electron emission characteristics.

Furthermore, boron nitride material is formed to a thickness of 100 μm or less on the surface of an electrically conducting material (the electrode material referred to above) 82. Preferably by forming the film thickness to 50 μm or less, the manufacturing time can be reduced compared to the case of using a single crystal which requires much manufacturing time and the cost is high, while maintaining the electron emission characteristics to a certain extent. Therefore the material cost can be reduced, as well as the overall cost. Alternatively, as stated above, powdered boron nitride material can be fixed in electrical contact with the electrically conducting portion that forms the electrode. In this case the manufacturing process is simplified and the cost is reduced compared with the case where a single crystal of boron nitride is used.

Next, the structure and method of manufacture of the projections 84 on the substrate 81 is explained. If the substrate 81 is a metal material, the projections can be formed as a replica of a previously manufactured form by the electroforming method using a polymer or resist (normally a dry resist film is used) pattern as the form. Common electrically conducting materials may be used for the metal layer 72, for example, metals such as Ni, Cr, Au, Mo, W, Pt, Ti, Al, Cu, Pd, and so on, or alloys such as Ni—Cr, and so on. Furthermore, the metal layer may be manufactured using a gaseous phase film forming method such as vacuum vapor deposition, ion plating, cluster ion beam vapor deposition, sputtering, magnetron sputtering, or the wet printing method using the screen method or inkjet method, and so on, on the polymer or resist pattern. It is preferable that the film thickness d of the metal layer be within the range 100 Å to 1 μm from considerations of cost, resistance of the metal layer, peeling due to stresses within the metal layer, and so on.

Embodiment 9

The present embodiment relates to a charging device using an electron emission element structured according to any of Embodiments 1 through 8 described above, as means for applying charge to an object to be charged (for example, an image carrier).

Figure 9:
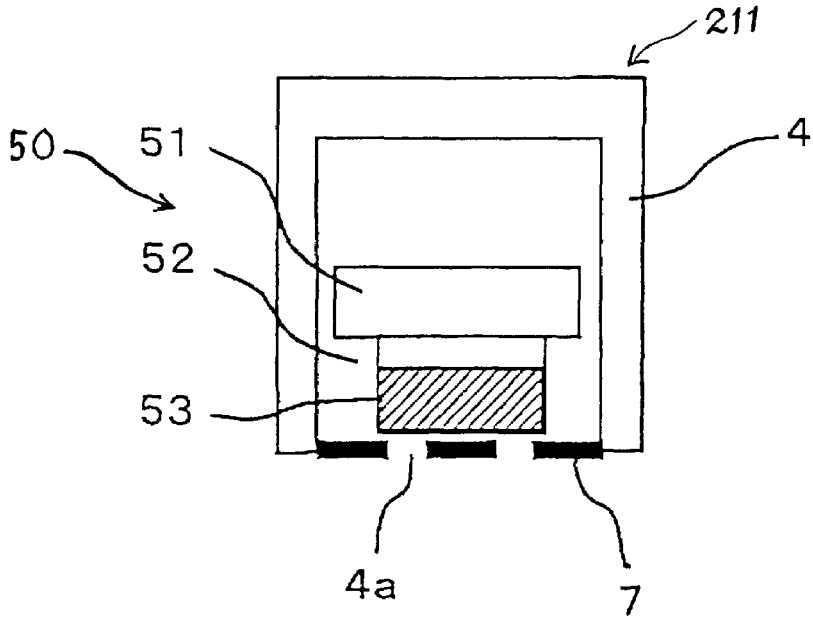
FIG. 9 is a section view showing the schematic structure of the charging device according to embodiment 9 of the present invention.

FIG. 9 shows an example of the structure of a charging device according to the present embodiment. The main parts of a charging device 211 are explained using for example the electron emission element 50 shown in FIG. 5 as explained in Embodiment 3. In other words, the electron emission element 50 uses a composite substrate in which a metal layer 52 is provided on an insulating material 51 as substrate for forming the boron nitride material. A thin film 53 of boron nitride is formed on the metal layer 52. Also, if powder of the same material is dispersed and fixed to form the thin film 53 of boron nitride, the same performance and function are obtained. The material and film thickness of the insulation material 51 and the metal layer 52 are the same as explained for Embodiment 3, so their explanation is omitted here.

The following is a more specific explanation of the method of manufacturing the electron emission element 50.

Using 300 mm×7 mm, thickness 1.3 mm pyrex (registered trademark) glass as the insulating material 51, a thin film of Ni was deposited to a thickness of about 2 μm by the sputtering method to form the metal layer 52. Then a thin film 53 of boron nitride was deposited on the metal layer 52 using the CVD reaction vessel 31 as the forming apparatus shown in FIG. 3, by irradiating using mixed gas plasma (diborane: boron hydride $B_2H_6$, hydrogen, ammonia, argon) and an ultra-violet excimer laser (wavelength λ: 193 nm, frequency f: 1030 Hz).

The charging device 211 houses the electron emission element 50 as described above in an approximately channel-shaped case 4. An aperture 4*a* of the case 4 is disposed in opposition to the object to be charged (for example, an image carrier). Also, a stainless steel grid 7 is installed in the aperture 4*a* of the case 4, configured so that a voltage is applied to the grid 7 from a power source.

Here, stainless steel plate in a honeycomb structure as conventionally used in the scorotron charging method is used as the grid 7. However, an electrically conducting membrane through which electrons can pass or an electrically conducting plate member with holes formed may be used.

The distance between the electron emission element 50 and the grid 7 is 50 μm, the gap between the grid 7 and an image carrier 201 is 1 mm. A voltage of −200V is applied to the electron emission element 50 from the power source, and a voltage of −650V is applied to the grid 7 from another power source. The aperture 4*a* of the case 4 is disposed in opposition to the image carrier, to carry out non-contact charging.

Using the charging device 211, the surface of the image carrier was charged to −600V when the speed of the image carrier was 200 mm/second. By varying the voltage applied to the grid 7, the voltage on the surface of the image carrier is also varied. When a voltage of −850V is applied to the grid 7, it was confirmed that the image carrier was charged to about −800V. Also, if the voltage applied to the grid 7 is reduced, it was confirmed that the voltage on the surface of the image carrier also reduces accordingly.

In this way, by disposing the electrically conducting member (grid) 7 that controls the surface voltage of the image carrier in the gap between the boron nitride material 53 and the surface of the image carrier, even if the gap between the boron nitride material 53 and the surface of the image carrier increases, it is possible to obtain the required charging voltage. In this way, charging from a distance is possible, so it is possible to prevent soiling due to toner or the like. In addition, the charging voltage can be stabilized, it is possible to prevent damage due to impact of foreign matter or the image carrier with the electron charging element 50, and the member life of the boron nitride material can be extended. Also, by using the electron emission element 50 using the boron nitride material in the charging device 211, it is possible to charge the image carrier without generating ozone or oxides of nitrogen (NOx) as stated previously. Furthermore, electron emission can be carried out at low energy, so organic materials such as polycarbonate in the image carrier is not attacked, oxidized, or consumed by combustion. Therefore removal of the film of the photosensitive material can be reduced. Also, it is possible to reduce the applied voltage compared with the conventional scorotron charging or roller charging methods. Therefore, it is possible to provide an energy efficient image forming apparatus.

FIG. 9 shows an example of a charging device that uses the electron emission element 50 with the structure shown in FIGS. 5A and 5B, explained in Embodiment 3. However, the present embodiment is not limited to this, and the charging device can likewise use electron emission elements according to any of Embodiments 1, 2, or 4 through 8.

Embodiment 10

Figure 10:
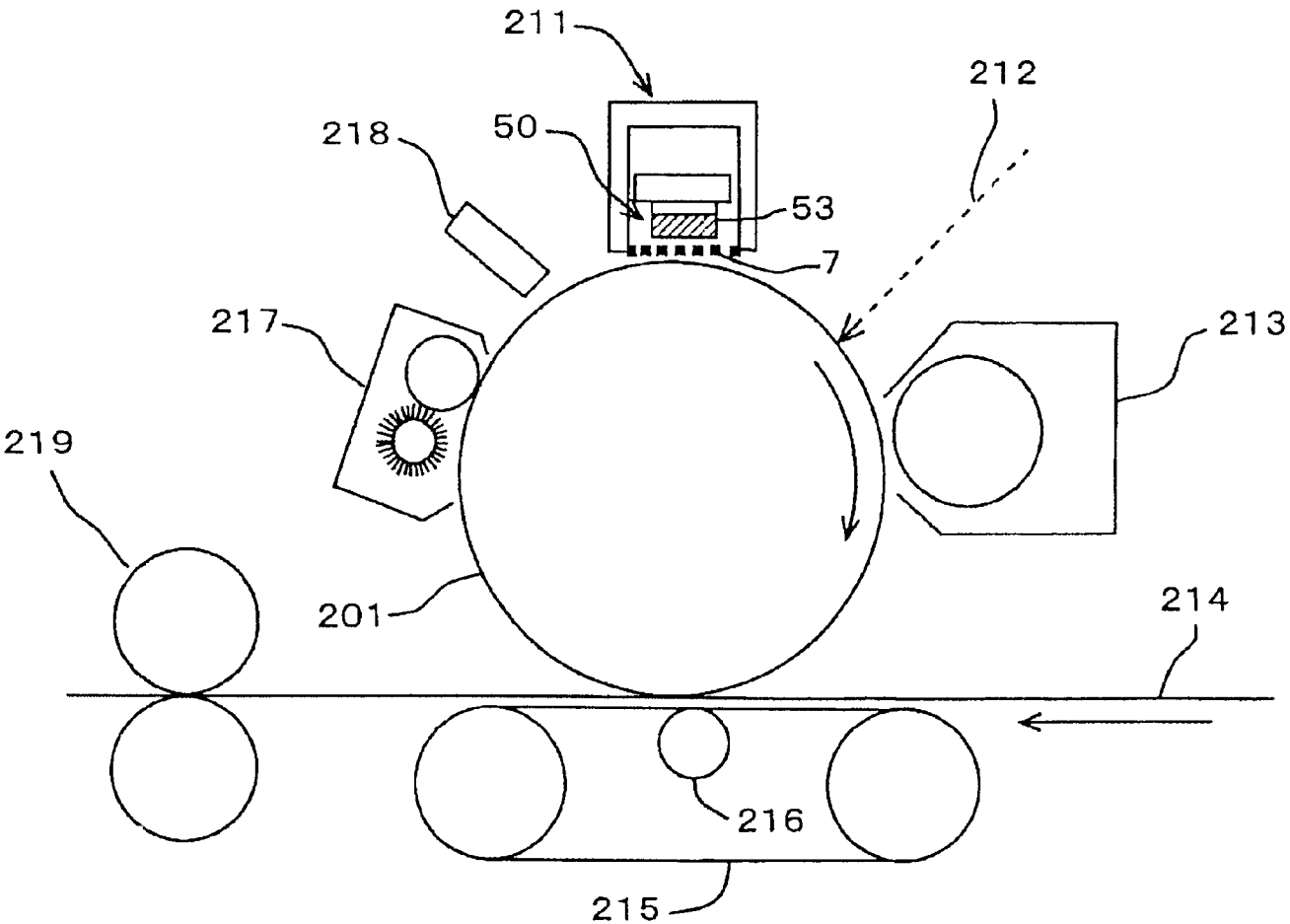
FIG. 10 is a section view showing the schematic structure of the image forming apparatus according to embodiment 10 of the present invention.

The present embodiment relates to an image forming apparatus that uses as the charging device that charges the image carrier an electron emission element structured according to any of the above Embodiments 1 through 8, or the charging device according to Embodiment 9. As shown in FIG. 10, the image forming apparatus uses a charging device 211 structured as shown in FIG. 9 as charging means for applying charge to an image carrier (for example, a photo sensitive drum) 201.

In the image forming apparatus, the charging device 211 is disposed on the periphery of the photosensitive drum 201. The charging device 211 includes an electron emission element 50 as described above, and charges the surface of the photosensitive drum 201 that rotates in the direction of the arrow shown in the figure. An electrostatic latent image is formed on the charged photosensitive drum 201 by laser light 212 radiated from a writing device that is not shown on the drawings in accordance with image data of a document image, or the like. Also, a developing device 213 that develops electrostatic latent images, a transfer device 216 that transfers toner images on the photosensitive drum 201 to a transfer medium 214, a transfer medium transport belt 215, a cleaning device 217 that removes toner remaining on the photosensitive drum 201 after transfer, and a decharging device 218 that removes any charge remaining on the photosensitive drum 201 are disposed around the periphery of the photosensitive drum 201. Also, the image forming apparatus includes a fixing device 219 that carries out a fixing process on the transfer medium 214 onto which a toner image has been transferred.

Here, the distance (gap G) between the electron emission element 50 of the charging device 211 and the surface of the photosensitive drum 201 is 50 μm. By applying a voltage of −150V to the electron emission element 50, negative ions generated by the electrons emitted from the electron emission element 50 adhere to the photosensitive drum 201, charging the surface of the photosensitive drum 201. After charging, the photosensitive drum 201 is rotated at 200 mm/second, and laser light 212 from a writing device that is not shown on the drawings irradiates the photosensitive drum 201 to form an electrostatic latent image. Then the electrostatic latent image is developed and made visible by the developing device 213 using toner developer. The toner image formed on the photosensitive drum 201 is next transferred onto the transfer medium 214, such as paper or the like, by the transfer device 216. The transfer medium 214 on which the toner image was transferred is transported to the fixing device 219 by the transfer medium transport belt 215. After the toner image is fixed on the transfer medium 214 by the fixing device 219, the transfer medium 214 is discharged to a discharge unit that is not shown on the drawings. On the other hand, a minute amount of transfer residual toner remains on the photosensitive drum 201 after the toner image is transferred. However, next the transfer residual toner is removed by the cleaning device 217, then the decharging device 218 removes charge from the photosensitive drum 201 as necessary, in preparation for the next image forming process.

Also, a structure with no cleaning process, in which a cleanerless process is carried out, and toner remaining after transfer is recovered in the developing device may also be used.

A characteristic of the image forming apparatus according to the present embodiment is that the electron emission element of the charging device 211 uses boron nitride material. Therefore, as stated previously the photosensitive drum 201 can be charged without generating ozone or oxides of nitrogen (NOx). Furthermore, electron emission can be carried out at low energy, so the polycarbonate or other organic material in the photosensitive drum 201 is not attacked, oxidized, or subject to combustion, so the amount of reduction in the photosensitive film can be reduced. Therefore, compared with image forming apparatus that use conventional corona discharge or roller charging methods, a long life and energy efficient image forming apparatus can be achieved.

This image forming apparatus has been explained using as an example, the charging device 211 with the structure shown in FIG. 9 as charging means. However, by using the electron emission element 70 with the structure explained under Embodiment 6 and shown in FIG. 7 as the electron emission element in the charging device, it is possible for the charging device to be combined with latent image forming means that forms the electrostatic latent image by providing the charge to the image carrier. In this case it is possible to directly form the required latent image on the image carrier when charging. Therefore, a light exposure device (for example, the writing device that emits the laser light 212 described above) that forms the latent image on the photosensitive member, which is an opto-semiconductor image carrier, is not necessary. Therefore, it is possible to reduce the cost of the image forming apparatus.

Embodiment 11

The present embodiment relates to a process cartridge that includes the charging device and at least one of the image carrier, developing means, transfer means, and cleaning means. The process cartridge is capable of being freely inserted into and removed from an image forming apparatus. The charging means may use the charging device according to Embodiment 9, or any of the electron emission elements structured according to Embodiments 1 through 8.

Figure 11:
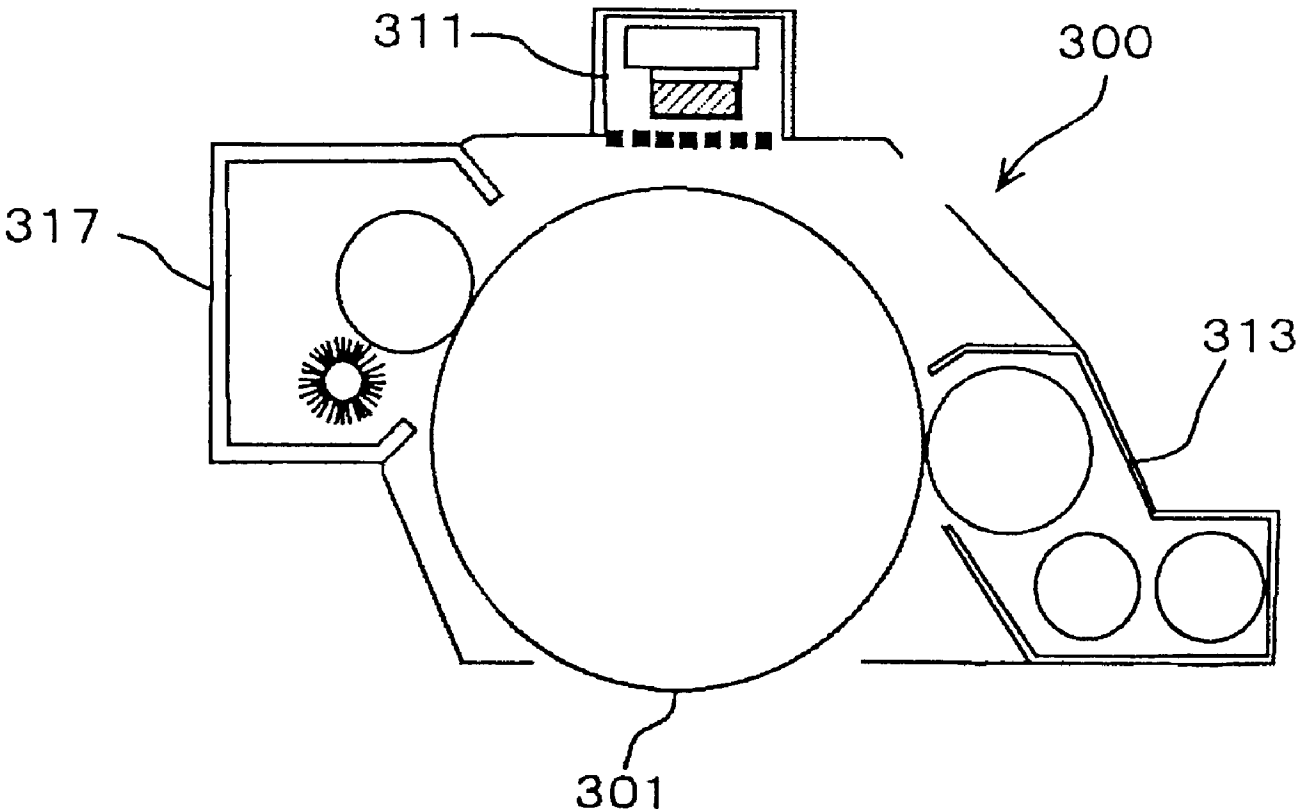
FIG. 11 is a section view showing the schematic structure of the process cartridge according to embodiment 11 of the present invention.

FIG. 11 shows the schematic structure of a process cartridge according to the present embodiment. A process cartridge 300 includes a photosensitive drum 301, which is the image carrier, charging means 311 using a electron emission element or charging device according to the present invention, developing means 313, and cleaning means 317 integrally connected as a process cartridge. The process cartridge 300 is configured to be capable of being inserted into and removed from an image forming apparatus such as a composite machine, printer, or the like. As an example, the photosensitive drum charging device, developing device, and cleaning device of the image forming apparatus shown in FIG. 10 can be used in the process cartridge 300 shown in FIG. 11. Also, the image forming operation is the same as that described in Embodiment 10, even if the process cartridge 300 is used.

The structure of the process cartridge according to the present invention is not limited to the structure of the present embodiment shown in FIG. 11. The process cartridge can be configured to include the charging means 311 using the charging device or the electron emission element according to the present invention, and at least one of the image carrier 301, the developing means 313, and the cleaning device 317.

In the present embodiment, the charging means 311 is provided within the process cartridge 300, which can be freely inserted into and removed from the main apparatus. Therefore, maintainability can be improved, and the charging device can be changed integrally with other devices.

Embodiment 12

The present embodiment relates to a color image forming apparatus that uses a process cartridge.

Figure 12:
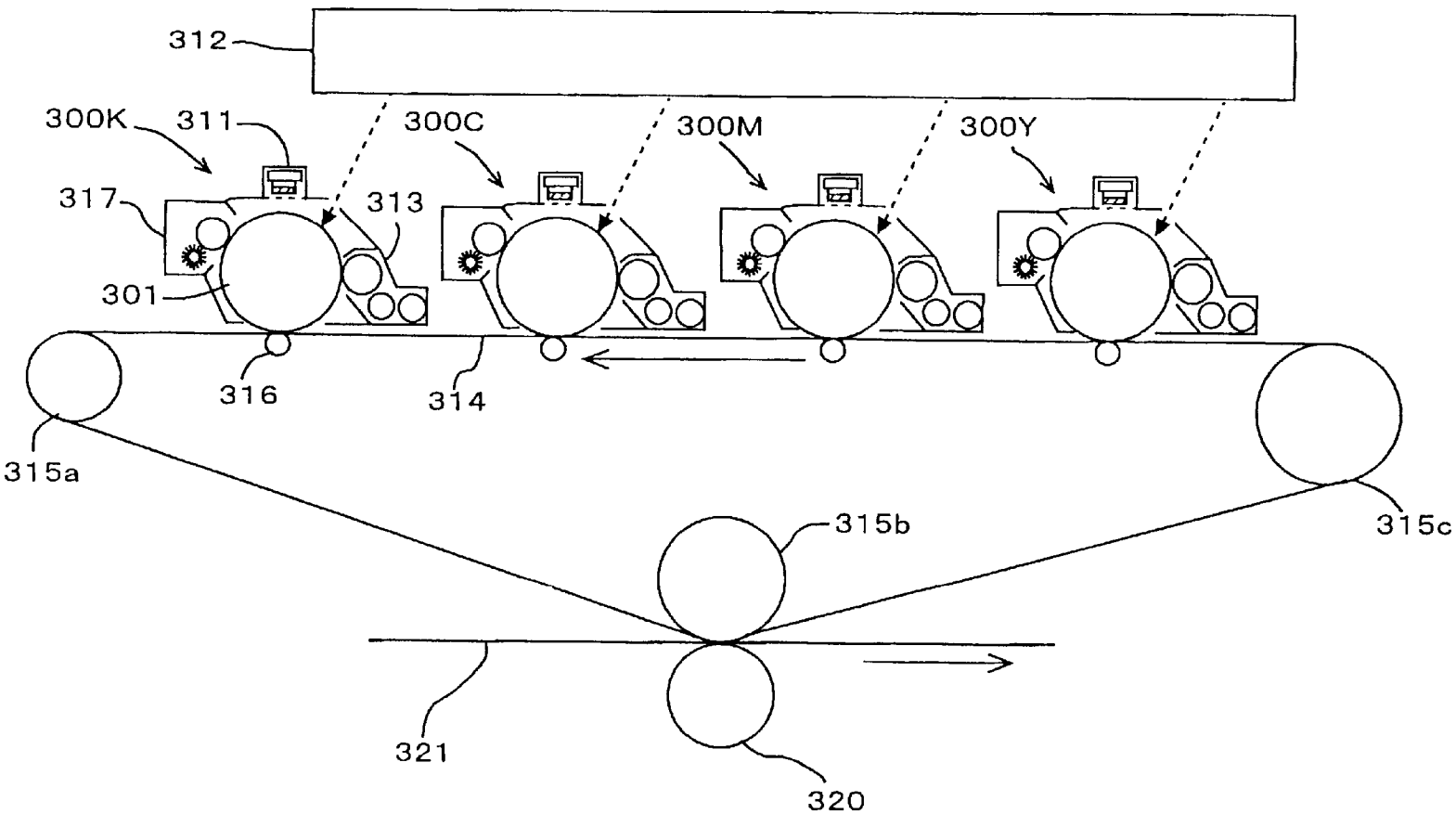
FIG. 12 is a diagram showing the schematic structure of a color image forming apparatus having a process cartridge according to embodiment 12 of the present invention.

FIG. 12 shows the schematic structure of a color image forming apparatus using the process cartridge. The image forming apparatus is a color image forming apparatus in which process cartridges 300Y, 300M, 300C, and 300K that form images in each of the colors yellow (Y), magenta (M), cyan (C), and black (K) are aligned along an endless belt-shaped intermediate transfer member (hereafter referred to as the intermediate transfer belt) 314 that extends in the horizontal direction. The intermediate transfer belt 314 is supported by a plurality of support rollers 315*a*, 315*b* and 315*c*. The structure of each process cartridge 300Y, 300M, 300C, and 300K is configured the same as, for example, the process cartridge 300 explained in Embodiment 11 and shown in FIG. 11, and only the color of the developer used in the developing means 313 differs. A writing device 312 is disposed above each process cartridge 300Y, 300M, 300C, and 300K, to form latent images by irradiating each photosensitive drum 301 with laser light, if necessary. Also, primary transfer means 316 is disposed at positions in opposition to the photosensitive drum 301 of each process cartridge 300Y, 300M, 300C, and 300K with the intermediate transfer belt 314 therebetween, the primary transfer means being means for transferring and superimposing the toner images formed on each photosensitive drum 301 to the intermediate transfer belt 314. Furthermore, roller-shaped secondary transfer means (hereafter referred to as the secondary transfer roller) 320, that transfers the superimposed image on the intermediate transfer belt 314 to a transfer medium 321 in one operation, is disposed in a position in opposition to the support roller 315*b* on the lower side of the intermediate transfer belt 314. Also, although not shown on the drawings, a sheet supply unit that houses transfer media 321, and sheet supply and transport means for supplying and transporting transfer media 321 from the sheet supply unit to the secondary transfer unit are disposed upstream of the secondary transfer roller 320 in the direction of transport of the transfer member. Furthermore, although not shown on the drawings, a fixing device that carries out a fixing process on images transferred to the transfer medium 321, a sheet discharge unit that discharges sheets after fixing, and so on, are disposed downstream of the secondary transfer roller 320 in the direction of transport of the transfer media.

When the charging means 311 of each process cartridge 300Y, 300M, 300C and 300K uses the electron emission element 70 explained in Embodiment 6 and shown in FIGS. 7A and 7B as the electron emission element, the charging means 311 can also combine the latent image forming means that forms electrostatic latent images by providing charge to the photosensitive drum 301. Therefore, it is possible to directly form the required latent image on the image carrier when charging. Therefore, in this case, a light exposure device (for example, the writing device 312 that emits the laser light described above) that forms the latent image on the photosensitive member, which is an opto-semiconductor image carrier, is not necessary. Therefore, the structure of the color image forming apparatus becomes the structure shown in FIG. 13, and it is possible to reduce the size and the cost of the image forming apparatus.

Figure 13:
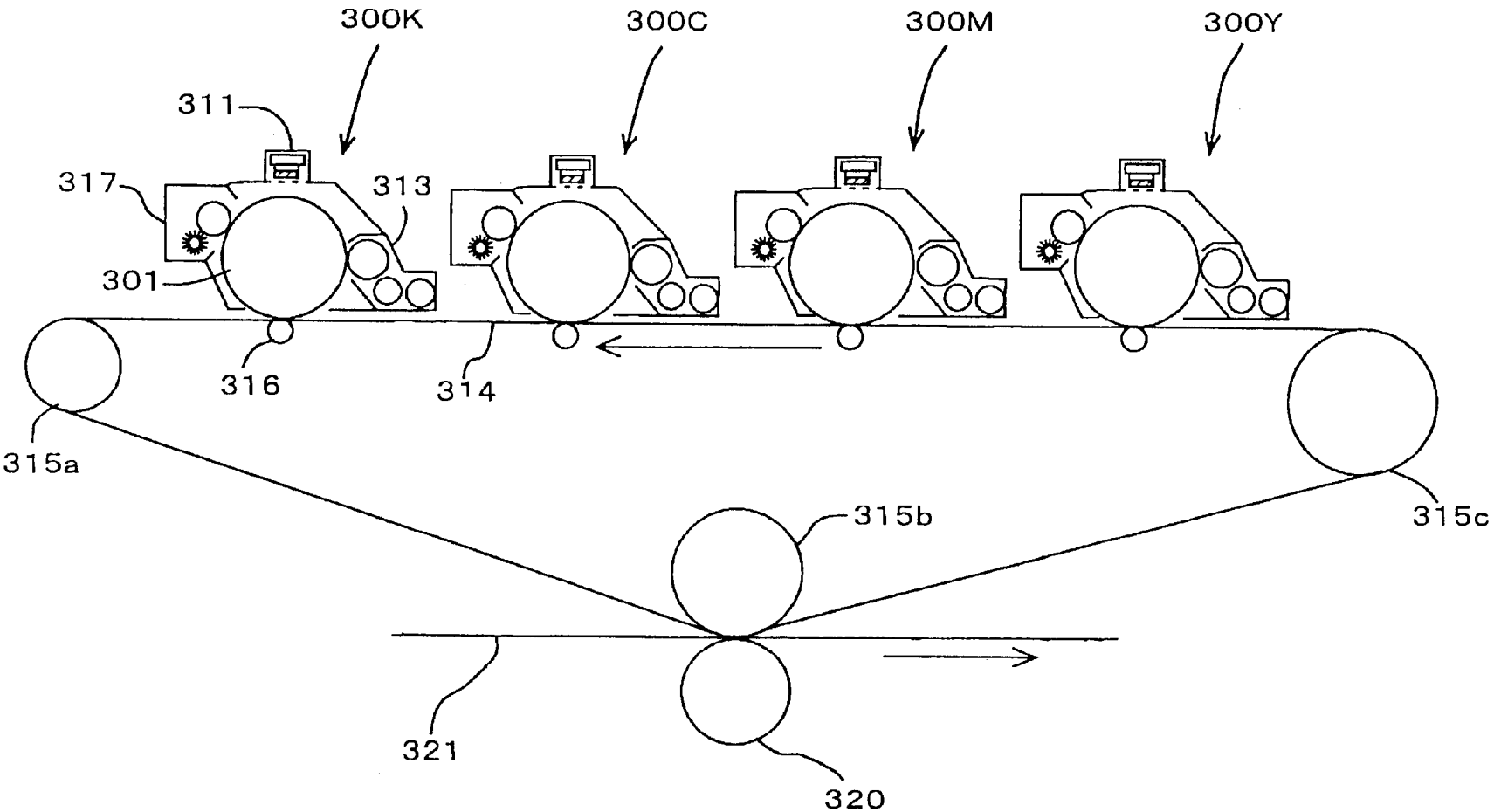
FIG. 13 is a diagram showing another schematic structure of a color image forming apparatus having a process cartridge according to embodiment 12 of the present invention.

In the color image forming apparatus shown in FIG. 12 or FIG. 13, latent images are formed on each photosensitive drum 301 in each process cartridge 300Y, 300M, 300C and 300K corresponding to each image color. Each latent image is developed and made visible with the toner of the respective developing means 313 of each color. Also, the developing toner on each photosensitive drum 301 is superimposed and transferred in turn by the primary transfer means 316 onto the intermediate transfer belt 314 to which a transfer voltage has been applied and which extends horizontally.

In this way, yellow, magenta, cyan, and black images are formed, superimposed and transferred onto the intermediate transfer belt 314 as a toner image, then transferred in one operation on to the transfer medium 321 at the secondary transfer roller 320. Also, the superimposed toner image on the transfer medium 321 is fixed by a fixing device that is not shown on the drawings. Then, after fixing, the transfer medium 321 is discharged by a discharge unit that is not shown on the drawings.

The order of the process cartridges 300 has been explained as yellow, magenta, cyan, and black. However, this order is not particularly required, and any order may be used.

Normally, a color image forming apparatus has a plurality of image forming units, so the apparatus becomes large. Also, the cleaning, charging, and other units can breakdown separately. When the time comes to change the units at the end of their life, changing the units takes a lot of time because of the complexity of the apparatus. Therefore, by connecting the image carrier 301, the charging means 311, the developing means 313, and other elements as the process cartridge 300, it is possible to provide a compact highly durable color image forming apparatus for which even a user can change the process cartridge 300.

Also, as stated above, when the charging means 311 also combines the latent image forming means that forms electrostatic latent images by providing charge to the photosensitive drum 301, a light exposure device (for example, the writing device 312 shown in FIG. 12) that forms the latent image on the photosensitive member is not necessary. Therefore, the structure of the color image forming apparatus becomes the structure shown in FIG. 13, it is possible to reduce the size and the cost of the image forming apparatus.

Embodiment 13

Figure 14:
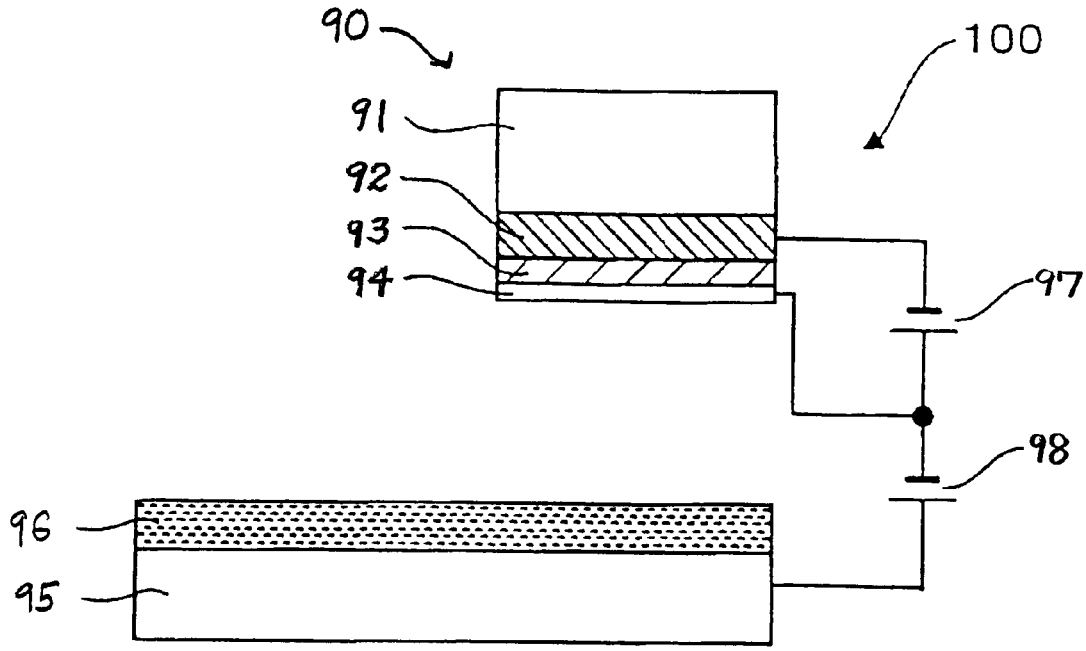
FIG. 14 is a diagram showing the schematic structure of a charging device according to embodiment 13 of the present invention.

As shown in FIG. 14, the electron emission element 90 according to the present embodiment includes a composite substrate in which an electrode layer 92 is provided on an insulating material 91 as substrate, and a thin film of boron nitride material 93 is formed on the electrode layer 92.

Also, if powder of the same material is dispersed and fixed to form the thin film of boron nitride material 93, the same performance and function are obtained. Furthermore, a thin film electrode 94 is provided on the boron nitride material 93 as a protective film.

Between the thin film electrode 94 and the electrode layer 92 a direct current drive power source 97 is provided. Also, between the thin film electrode 94 of the electron emission element 90 and an electrode 95 on the rear surface of an image carrier 96, a bias power source 98 is provided. Here, the electrode 95 is an electrically conducting support member grounded at zero potential.

The electron emission element 90, together with the direct current drive power source 97 and the bias power source 98, constitutes a charging device 100 according to the present embodiment.

As explained later, by providing the thin film electrode 94, it is possible to arbitrarily control the surface potential of the image carrier 96. In addition, the thin film electrode 94 has the function of protecting the surface of the electron emission element, so the life of the charging device can be extended.

Furthermore, the element nearest the surface, which has the biggest effect on the electron emission characteristics is covered, so stable electron emission characteristics can be obtained, unaffected by the surrounding environment.

Next, the operation of the charging device according to the present embodiment is explained.

A positive voltage is applied to the thin film electrode 94 of the electron emission element 90 and a negative voltage is applied to the electrode layer 92, by the direct current drive power source 97. If the potential difference is such that electrons can overcome the energy barrier of the boron nitride material 93, electrons are emitted. The emitted electrons tunnel through the thin film electrode 94, and electrons having a predetermined activation energy are emitted out towards the image carrier 96. During flight, the electrons are absorbed by air molecules to form low energy negative ions. When the negative ions or electrons reach the image carrier 96, the image carrier 96 is negatively charged.

At this time, by adjusting the bias voltage applied between the thin film electrode 94 and the electrode 95 in the rear surface of the image carrier 96 by the bias power source 98, the charging potential of the image carrier 96 can be adjusted. In addition the activation energy of the electrons emitted from the electron emission element 90 can be controlled.

The following is further explanation regarding the function of the thin film electrode 94 in protecting the surface of the electron emission element.

Toner, particles of paper, and metal oxides ($Al_2O_3$, $MgO_2$, $SiO_2$, and so on) originating from these become dispersed within electrophotographic apparatus. Without the thin film electrode 94, these would impact or adhere to the surface of the element, and change the surface structure and surface energy (state of adhering matter) of the boron nitride material 93. Therefore, the emission characteristics will change, and depending on the circumstances the element itself could breakdown.

By providing the thin film electrode 94, these problems can be reduced to the extent that they are no longer problems for practical purposes.

Figure 15:
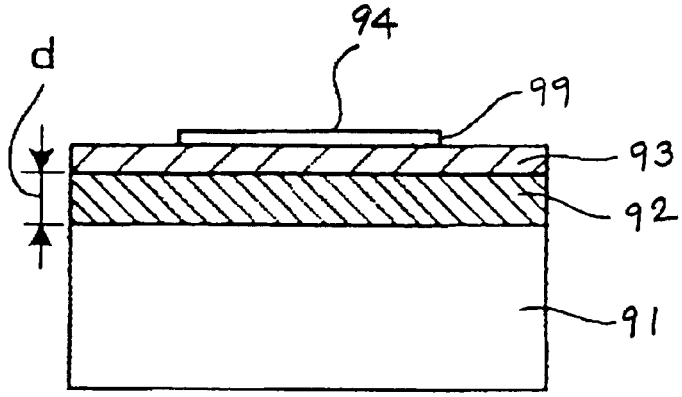
FIG. 15 is a section view showing the structure of an electron emission element according to embodiment 13 of the present invention.

The effect of the surface protection function is not sufficiently achieved if at least the full surface of the element is not covered. As shown in FIG. 15, if the thin film electrode 94 only partially covers the surface of the element, on the contrary electrical fields become concentrated at the edge portions 99 of the thin film electrode 94, and the electron emission characteristics are adversely affected.

Furthermore, if there are ionic impurities (Na ions or urea originating in the human body, and soon) in the environment of use, they could cause local galvanic reactions on these parts, and cause erosion of the element.

Quartz glass, pyrex (registered trademark) glass, borosilicate glass, soda-lime glass, a glass substrate on which a $SiO_2$ film is formed to block impurities from the surface, and ceramic substrates such as alumina, magnesia, and so on, may be used as the insulating material 91.

Common electrically conducting materials may be used for the electrode layer 92, for example, metals such as Ni, Cr, Au, Mo, W, Pt, Ti, Al, Cu, Pd, and so on, or alloys such as Ni—Cr, and so on.

The method of manufacturing the electrode layer (metal layer) 92 may be a gaseous phase film forming method such as vacuum vapor deposition, ion plating, cluster ion beam vapor deposition, sputtering, magnetron sputtering, or the wet printing method using the screen method or inkjet method, and so on.

It is preferable that the film thickness d of the metal layer 92 be within the range 100 Å to 10 μm from considerations of cost, resistance of the metal layer, peeling due to stresses within the metal layer, and so on.

Next, it is required that the material of the thin film electrode 94 should have a resistivity low enough to satisfy the function as an electrode, be easily formed into a thin film, be stable in air, and so on. As a result of diligent search of materials from this viewpoint, it was found that Au, Pt, Ir, Cs, Rh, and Ru, or alloys of these single elements, or combinations of these single elements and alloys are ideal.

If other materials are used, such as highly reactive metals such as for example, Al, Fe, the changes with time are large, which can cause problems. For example, in the case of Al, oxides can easily form in air, and this can cause a change in the work function of the thin film electrode 94, which causes the electron emission characteristics to change with time.

In contrast, materials formed from the above single elements, alloys, or combinations (mixtures) of the above single elements and alloys have excellent stability in air, and maintain stable electron emission characteristics. Ir, PtIr, $IrO_2$, and so on, can be cited as specific examples of alloys and similar used in the present embodiment.

Next, the following is an explanation of the film thickness of the thin film electrode 94.

The thickness of the thin film electrode 94 should be between 3 nm and 400 m thick so that the electrons can be promptly emitted via the thin film electrode 94 and so that the thin film electrode 94 can function as an electrode. In this case the durability of the electron emission element is improved, and good electron emission characteristics can be maintained. In particular, if the thickness is not less than 40 nm, many of the electrons that over come the surface potential barrier of the boron nitride material as a result of the electric field applied to the material will be lost passing through the thin film electrode (in some cases the electrons are not able to tunnel through). Therefore these electrons are not emitted into the atmosphere.

On the other hand, if the thickness is less than 3 nm, continuity of the thin film electrode is lost, and it ceases to function as an electrode. From these considerations, it is preferable that the thickness of the thin film electrode 94 is within the range 5 nm to 20 nm.

Figure 16:
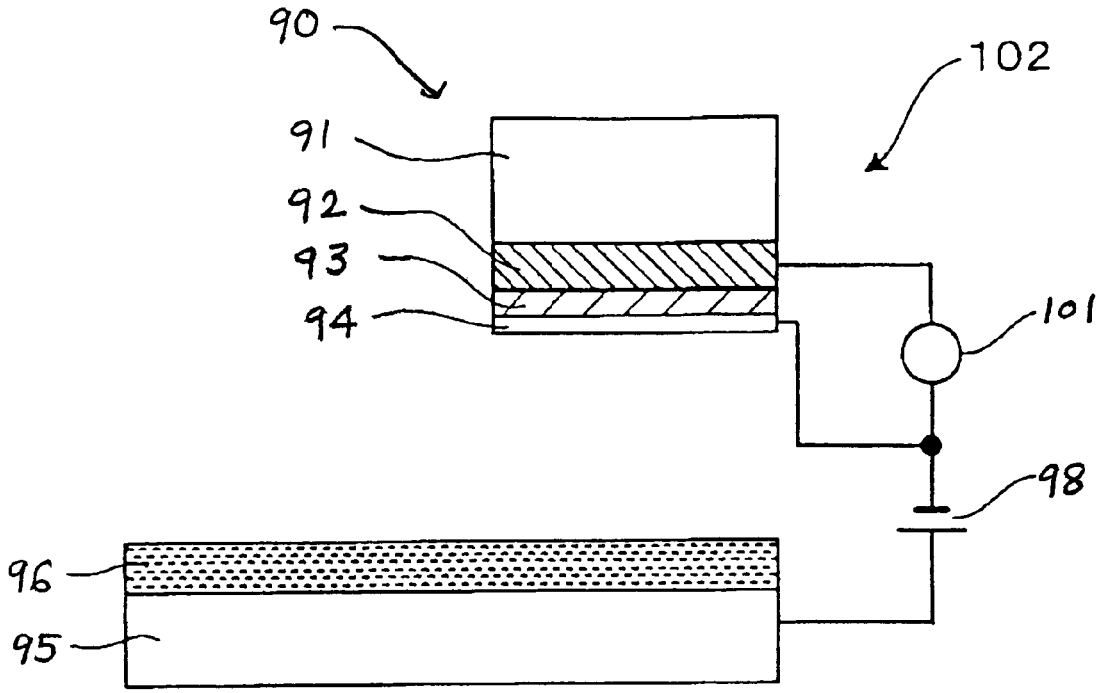
FIG. 16 is a diagram showing the schematic structure of a charging device according to embodiment 13 of the present invention.

As shown in FIG. 16, it is a characteristic of the present embodiment that an alternating current voltage or a pulse voltage is applied between the thin film electrode 94 and the electrode layer 92 of the electron emission element 90, using a drive power source 101.

The electron emission element 90, together with the bias power source 98 and the drive power source 101, constitutes a charging device 102 according to the present embodiment. In this case, in addition to the effects as explained in the case of FIG. 14, the following effects can be obtained. In other words, if a negative voltage is first applied to the thin film electrode 94 of the electron emission element 90 using the drive power source 101, electrons will accumulate to a certain extend with in the boron nitride material 193. Next, when a positive voltage is applied to the thin film electrode 94, a large quantity of electrons, including those that have accumulated, will be discharged to the outside.

Therefore, better charging performance can be obtained than in the case of FIG. 14. Further, unlike the case when using the direct current power source 97 as described for FIG. 14, the activation energy per electron of the electrons emitted from the electron emission element 90, and the total number of electrons emitted can be independently controlled. Therefore, it is possible to achieve both reduction in generation of discharge products and good charging performance.

The Embodiments 1 through 13 of the electron emission element, the charging device using this electron emission element, the process cartridge, and the image forming apparatus according to the present invention were explained above. However, the electron emission element using $Sp^3$-bonded boron nitride with excellent electron emission characteristics according to the present invention is not limited to charging devices, process cartridges, and image forming apparatus, its range of application is very diverse and broad, and it is expected that in the future it will make a big contribution to the development of industry. In other words, the present invention paves the way for the construction of high brightness, high efficiency illumination systems by emitting electron beams with a current density of 1000 times conventional beams, image display devices that display extremely fine detail (application to mobile telephones, wearable computers, and so on), using the property that sufficient current can be obtained using a minute electron emission area, formation of special electron emission patterns using the property that the electron emission properties are superior only on areas irradiated with ultra-violet light during manufacture, use as a high brightness nano-electron source, and also ultra-small electron beam sources, and so on. As a result it is possible that this can lead to a revolution in all kinds of electrical equipment and devices used in all aspects of modern life, starting with illumination and image display devices.

Also, according to the present invention, the following significant effects can be obtained.

(1) In the electron emission element according to the first means, by using boron nitride (BN) material as the electron emission material, and using a metal material or a semiconductor material as the substrate for forming the boron nitride material, it is possible to obtain good quality boron nitride material on the substrate. Also, it is possible to apply a voltage to the material to emit electrons, and electrons are provided.

(2) In the electron emission element according to the second means, in addition to the structure of the first means, by using $Sp^3$-bonded boron nitride as the boron nitride material, a field electron emission element can be achieved from which high efficiency electron emission characteristics unprecedented in conventional art can be obtained.

(3) In the electron emission element according to the third means, in addition to the structure of the second means, by using $SP^3$-bonded 5H—BN material or $SP^3$-bonded 6H—BN material as the $SP^3$-bonded boron nitride, a field electron emission element can be achieved from which high efficiency electron emission characteristics unprecedented in conventional art can be obtained.

(4) In the electron emission element according to the fourth means, in addition to the structure of any of the first through third means, by using flexible ribbon-shaped metal as the metal material in the substrate, high efficiency electron emission characteristics unprecedented in conventional art can be obtained, as well as the element itself can be made thin and small, and can be fitted to a free shape (for example, a curve, or the like).

(5) In the electron emission element according to the fifth means, in addition to the structure of any of the first through third means, by using a composite substrate in which a metal layer is provided on an insulating material as the substrate, high efficiency electron emission characteristics unprecedented in conventional art can be obtained, as well as an electron emission element that is long and with a large area can be manufactured, and the range of selection of substrate materials is broadened, so the manufacturing cost can be reduced.

(6) In the electron emission element according to the sixth means, in addition to the structure of any of the first through third means, by using a composite substrate in which a semiconductor layer is provided on an insulating material as the substrate, high efficiency electron emission characteristics unprecedented in conventional art can be obtained, as well as an electron emission element that is long and with a large area can be manufactured, and the range of selection of substrate materials is broadened, so the manufacturing cost can be reduced.

(7) In the electron emission element according to the seventh means, in addition to the structure of the fifth or sixth means, by using a composite substrate using a polymer film as the insulating material, high efficiency electron emission characteristics unprecedented in conventional art can be obtained. In addition, it is possible to manufacture the element itself thin and small, and furthermore it is possible to fit the element to a free shape (for example, a curve, or the like). Also, the range of selection of substrate materials is broadened, so the manufacturing cost can be reduced. In particular, during manufacture feeding the substrate to the apparatus can be carried out by the roll to roll system, rather than the sheet feed system, so production can be continuous, and the cost reduction effect can be large.

(8) In the electron emission element according to the eighth means, in addition to the structure of the seventh means, by using a composite substrate using a polymer film with a film thickness between 50 μm and 3 mm as the insulating material, warping and shrinkage of the substrate occurring during manufacture of the field electron emission element, and damage to the element occurring as a result or the warping and shrinkage, can be maintained at a level that in practical terms is no problem. Also, as stated above, in combination with the characteristics as a polymer film the effect in mass production is large. Also, the element itself is thin and can be made small, so it is possible to achieve an element that can be fitted to a free shape (for example, a curve, or the like).

(9) In the electron emission element according to the ninth means, in addition to the structure of any of the first through eighth means, the electron emission part is separated into a plurality of independent areas, and voltage supply means is provided capable of independently setting and applying a voltage to each of the areas. In this way it is possible to charge or not charge an object for charging, such as an image carrier or similar, in one dot units. When used in an image forming apparatus, it is possible to directly form the required latent image of the image carrier when charging. Hence a light exposure device that forms latent images on a semiconductor body, which is the photosensitive member as the image carrier, is not required. Therefore it is possible to reduce the cost of the image forming apparatus.

(10) In the electron emission element according to the tenth means, in addition to the structure of any of the first through ninth means, the surface of the substrate is provided with a plurality of projections with pointed tips. Also, the film thickness of the electron emission material formed on the substrate is 100 μm or less. In this way, even if the electron emission material (boron nitride material, or the like) does not have a shape with pointed projections, electric fields are concentrated by the projection shape provided on the substrate, which promotes electron emission. Also, coupled with the negative electron affinity (NEA) characteristics of the material itself, it is possible to achieve an electron emission element from which high efficiency electron emission characteristics that are unprecedented in the conventional art can be obtained. Furthermore, by forming the boron nitride material to a thickness of 100 μm or less on the surface of the electrically conducting material (the substrate referred to above), or more preferably to a thickness of 50 μm or less, the manufacturing time can be reduced compared with the case of using a single crystal which requires much manufacturing time and the cost is high, while maintaining the electron emission characteristics to a certain extent. Therefore the material cost can be reduced, as well as the overall cost. Alternatively, as stated above, powdered boron nitride material can be fixed in electrical contact with the electrically conducting portion that forms the electrode. In this case the manufacturing process is simplified and the cost is reduced compared with the case where a single crystal of boron nitride is used.

(11) In the charging device according to the eleventh means, by using an electron emission element according to any of the first to tenth means as means for applying charge to an object to be charged, such as an image carrier or similar, it is possible to charge the object to be charged without generating ozone or oxides of nitrogen (NOx). Also, it is possible to reduce the applied voltage compared with the conventional scorotron charging or roller charging methods, so it is possible to provide an energy efficient image forming apparatus.

(12) In the image forming apparatus according to the twelfth means, by providing an electron emission element according to any of the first to tenth means as means for applying charge to an image carrier, or the charging device according to the eleventh means, it is possible to charge the object to be charged without generating ozone or oxides of nitrogen (NOx). Also, it is possible to reduce the applied voltage compared with the conventional scorotron charging or roller charging methods, so it is possible to provide an energy efficient image forming apparatus. Furthermore, electron emission can be carried out at low energy, so attacking, oxidizing, or combustion of polycarbonate or other organic photosensitive material does not occur, so removal of the film of the photosensitive member can be reduced.

(13) In the image forming apparatus according to the thirteenth means, in addition to the structure of the twelfth means, the charging means forms the electrostatic latent image when applying charge to the image carrier (in other words, the charging means and latent image forming means are combined) Therefore it is possible to directly form the required latent image on the image carrier when charging. Hence a light exposure device that forms latent images on a semiconductor body which is the photosensitive member as the image carrier, is not required. Therefore it is possible to reduce the cost of the image forming apparatus.

(14) In the process cartridge according to the fourteenth means, by providing an electron emission element according to any of the first through tenth means, or the charging device according to the eleventh means, as charging means, in addition to the effect of any of the first through tenth means or the eleventh means, by providing the charging means within the process cartridge that can be freely inserted into or removed from the main body of an apparatus, maintain ability is improved, and the charging means can be changed integrally with other devices.

(15) In the image forming apparatus according to the fifteenth means, by providing a process cartridge according to the fourteenth means, it is possible to provide an image forming apparatus for which maintainability and operability when changing parts is improved.

(16) A multi-color or color image forming apparatus has a plurality of image forming units, so the apparatus becomes large. Also, each unit, such as cleaning or charging, and so on, can breakdown individually. When the time comes to change the units at the end of their life, changing the units takes a lot of time because of the complexity of the apparatus. However, by providing a plurality of process cartridges according to the fourteenth means in the image forming apparatus according to the sixteenth means, it is possible to provide a compact highly durable color image forming apparatus for which even a user can change the process cartridge.

(17) Furthermore, in the image forming apparatus according to the seventeenth means, in addition to the structure of the fifteenth or sixteenth means, the charging means of the process cartridge forms the electrostatic latent image when applying charge to the image carrier (in other words, the charging means and latent image forming means are combined). Therefore it is possible to directly form the required latent image on the image carrier when charging. Hence a light exposure device that forms latent images on a semiconductor body, which is the photosensitive member as the image carrier, is not required. Therefore it is possible to reduce the cost of the image forming apparatus.

Various modifications will become possible for those skilled in the art after receiving the teachings of the present disclosure without departing from the scope thereof.

What is claimed is:

1. An electron emission element comprising a substrate with a surface comprising a plurality of projections with pointed tips;

an electrode material on the plurality of projections; and an electron emission material comprising a boron nitride material on the electrode material, wherein the electron emission material has a thickness of 100 μm or less.

2. The electron emission element as claimed in claim 1, wherein the substrate comprises a metal material or a semiconductor material.

3. The electron emission element as claimed in claim 1, wherein the boron nitride material is $Sp^3$-bonded boron nitride material.

4. The electron emission element as claimed in claim 3, wherein the $Sp^3$-bonded boron nitride material includes hexagonal system 5H or 6H crystals as the main crystalline form.

5. The electron emission element as claimed in claim 1, wherein the substrate comprises the metal material; and the metal material is flexible and ribbon-shaped.

6. The electron emission element as claimed in claim 1, wherein the substrate is a composite substrate comprising a metal layer on an insulating material.

7. The electron emission element as claimed in claim 6, wherein the insulating material comprises a polymer film.

8. The electron emission element as claimed in claim 7, wherein the polymer film has a film thickness in a range of from 50 μm to 3 mm.

9. The electron emission element as claimed in claim 1, wherein the substrate is a composite substrate comprising a semiconductor layer on an insulating material.

10. The electron emission element as claimed in claim 9, wherein the insulating material comprises a polymer film.

11. The electron emission element as claimed in claim 10, wherein the polymer film has a film thickness in a range of from 50 μm to 3 mm.

12. The electron emission element as claimed in claim 1, wherein the electron emission material is divided into a plurality of independent areas, and voltage supply means is provided capable of independently setting and applying a voltage to each of the areas.

13. The electron emission element as claimed in claim 1, wherein the electrode material comprises an electrically conducting material; and the electron emission material comprises $Sp^3$-bonded boron nitride, which is formed as a thin film on the electrically conducting material.

14. The electron emission element as claimed in claim 1, wherein the electrode material comprises an electrically conducting material; and the electron emission material comprises $Sp^3$-bonded boron nitride, which is made into powder form, brought into electrical contact with the electrically conducting material, and dispersed and fixed.

15. A charging device that charges an object to be charged by applying charge thereto, wherein an electron emission element having electron emission characteristics is used as means for applying charge to the object to be charged, and the electron emission element comprises a substrate with a surface comprising a plurality of projections with pointed tips;

an electrode material on the plurality of projections; and an electron emission material comprising a boron nitride material on the electrode material, where the electron emission material has a thickness of 100 μm or less.

16. The charging device as claimed in claim 15, further comprising a protective film on the electron emission element.

17. The charging device as claimed in claim 16, wherein the protective film is a thin film electrode.

18. The charging device as claimed in claim 17, wherein the object to be charged is on an electrically conducting support member that is grounded at zero potential, and a bias voltage is applied between the electrically conducting support member and the thin film electrode on the electron emission element.

19. The charging device as claimed in claim 17, wherein the thin film electrode covers the entire electron emission element.

20. The charging device as claimed in claim 17, wherein the thin film electrode comprises either Au, Pt, Ir, Cs, Rh, or Ru, or an alloy of these single elements, or a mixture of one of the single elements and the alloy.

21. The charging device as claimed in claim 17, wherein the thin film electrode has a film thickness in a range of from 3 nm to 40 nm.

22. The charging device as claimed in claim 17, wherein a drive voltage of the electron emission element is either an alternating current voltage or a pulse voltage.

23. An image forming apparatus having at least an image carrier, charging means, developing means, transfer means, and cleaning means, wherein the charging means comprises an electron emission element comprising a substrate with a surface comprising a plurality of projections with pointed tips;

an electrode material on the plurality of projections; and an electron emission material comprising a boron nitride material on the electrode material, where the electron emission material has a thickness of 100 μm or less.

* * * * *